US010902783B2

(12) United States Patent
Park et al.

(10) Patent No.: US 10,902,783 B2
(45) Date of Patent: Jan. 26, 2021

(54) LIGHT EMITTING DISPLAY DEVICE AND DRIVING METHOD THEREOF

(71) Applicant: LG DISPLAY CO., LTD., Seoul (KR)

(72) Inventors: Joonmin Park, Paju-si (KR); Shinji Takasugi, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/553,034

(22) Filed: Aug. 27, 2019

(65) Prior Publication Data

US 2020/0074932 A1 Mar. 5, 2020

(30) Foreign Application Priority Data

Aug. 29, 2018 (KR) ..... 10-2018-0102104

(51) Int. Cl.

| | |
|---|---|
| ***G09G 3/32*** | (2016.01) |
| ***G09G 3/3258*** | (2016.01) |
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2320/0295* (2013.01)

(58) Field of Classification Search

CPC ... G09G 2300/0819; G09G 2300/0842; G09G 2310/0205; G09G 2310/0286; G09G 2310/08; G09G 2320/0238; G09G 2320/0295; G09G 3/3233; G09G 3/3258; G09G 3/3266; G09G 3/3291

USPC ..... 345/690–691

See application file for complete search history.

(56) References Cited

U.S. PATENT DOCUMENTS

2014/0267467 A1* 9/2014 Huang ..... G09G 3/3611 345/691
2017/0352317 A1* 12/2017 Huang ..... G02F 1/134309
2018/0012553 A1* 1/2018 Kim ..... G09G 3/3648

(Continued)

FOREIGN PATENT DOCUMENTS

| | | | |
|---|---|---|---|
| JP | 2015-129934 | A | 7/2012 |
| KR | 10-2015-0077815 | A | 7/2015 |
| KR | 10-2017-0080364 | A | 7/2017 |

*Primary Examiner* — Tony O Davis

(74) *Attorney, Agent, or Firm* — Seed IP Law Group LLP

(57) ABSTRACT

Provided is a light emitting display device and a method of driving the same. The light emitting display device includes: a display panel in which pixel lines including a plurality of pixels are divided into at least one area A and at least one area B; a panel driver connected to the pixel line; and a timing controller for controlling operation of the panel driver to perform image data writing (IDW) driving for sequentially writing input image data to a plurality of pixel lines included in one of the area A and the area B and to perform sensing data writing (SDW) driving for writing sensing data to a pixel line included in one of the area A and the area B in a vertical blank period in which image data writing driving is not performed. The timing controller writes coupling compensation data during the vertical blank period. According to the present disclosure, a device can be realized in consideration of a sensing deviation that may be generated in a compensation operation for improving deterioration of elements included in a display panel and increasing the lifespan thereof.

16 Claims, 21 Drawing Sheets

(56) References Cited

U.S. PATENT DOCUMENTS

| | | | | |
|---|---|---|---|---|
| 2018/0175135 | A1* | 6/2018 | Lim | H01L 27/3272 |
| 2018/0197453 | A1* | 7/2018 | Lee | G09G 3/32 |
| 2018/0315390 | A1* | 11/2018 | Kong | G09G 3/3677 |
| 2018/0350317 | A1* | 12/2018 | Shin | G09G 3/3648 |
| 2019/0251899 | A1* | 8/2019 | Lee | H01L 27/3265 |
| 2020/0160794 | A1* | 5/2020 | Park | G09G 3/3233 |

* cited by examiner

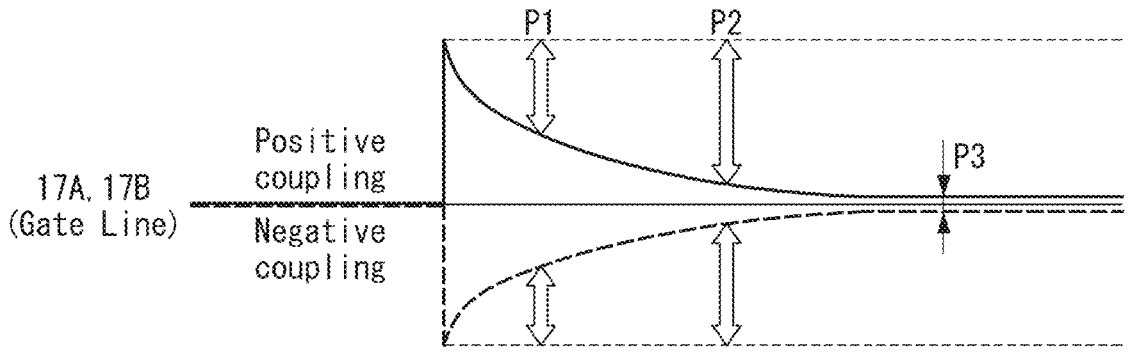
*Fig. 17*
Fig. 18
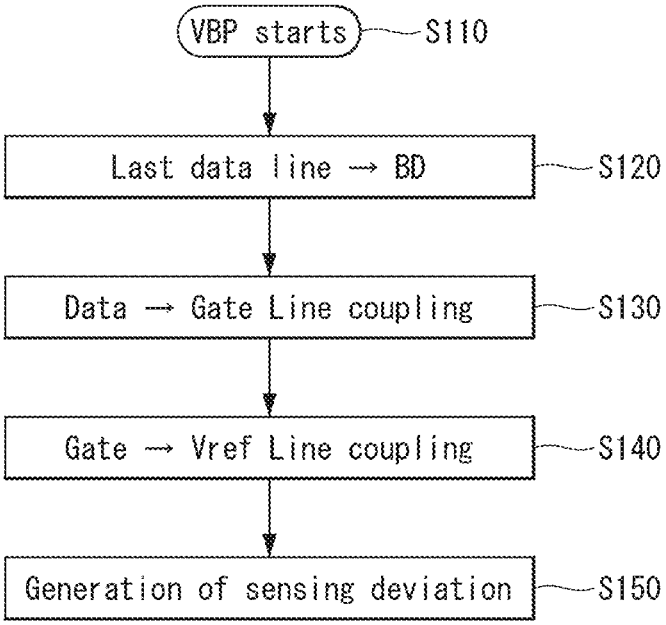
*Fig. 18*

LIGHT EMITTING DISPLAY DEVICE AND DRIVING METHOD THEREOF

CROSS-REFERENCE TO RELATED APPLICATION

This application claims the benefit of Korean Patent Application No. 10-2018-0102104, filed on Aug. 29, 2018, which is incorporated herein by reference for all purposes as if fully set forth herein.

BACKGROUND

Technical Field

The present disclosure relates to a light emitting display device and a method of driving the same.

Description of the Related Art

With the development of information technology, markets of display devices which are connection media between users and information are growing. Accordingly, display devices such as a light emitting display (LED), a quantum dot display (QDD) and a liquid crystal display (LCD) are increasingly used.

The aforementioned display devices include a display panel having sub-pixels, drivers which output driving signals for driving the display panel, a power supply which generates power to be provided to the display panel or the drivers, and the like.

The aforementioned display devices can display images in such a manner that selected sub-pixels transmit light or directly emit light when driving signals, for example, scan signals and data signals, are provided to sub-pixels formed in the display panel.

Meanwhile, although the light emitting display among the above-described display devices has many advantages such as electrical and optical properties of a high response speed, high luminance and a wide viewing angle and mechanical properties of a flexible form, it is desirable to improve deterioration of elements included in the display panel of the light emitting display or to increase the lifespan thereof.

BRIEF SUMMARY

The present disclosure provides a light emitting display device, comprising: a display panel including pixel lines having a plurality of pixels, the pixel lines being in a first area and a second area; a panel driver electrically connected to the pixel lines; and a timing controller configured to control operation of the panel driver to perform image data writing driving for sequentially applying input image data to a plurality of pixel lines included in one of the first area or the second area, and to perform sensing data writing driving for applying sensing data to a pixel line included in the one of the first area the second area during a vertical blank period in which the image data writing driving is not performed, wherein the timing controller writes coupling compensation data during the vertical blank period.

The present disclosure further provides a light emitting display device, comprising: a display panel including pixel lines having a plurality of pixels, the pixel lines being in a first area and a second area; a panel driver electrically connected to the pixel lines; and a timing controller configured to control operation of the panel driver to perform image data writing driving for sequentially writing input image data to a plurality of pixel lines included in one of the first area or the second area, and to perform sensing data writing driving for writing sensing data to a pixel line included in the one of the first area or the second area during a vertical blank period in which the image data writing driving is not performed, wherein the timing controller includes a deviation compensator configured to compensate a sensing deviation caused by coupling between horizontal lines and vertical lines in the display panel.

In another embodiment, the present disclosure provides a method of driving a light emitting display device having a display panel including pixel lines having a plurality of pixels, the pixel lines being in a first area and a second area, the method comprising; performing image data writing driving for sequentially writing input image data to a plurality of pixel lines included in one of the first area or the second area; performing sensing data writing driving for writing sensing data to a pixel line included in the one of the first area or the second area during a vertical blank period in which image data writing driving is not performed; and writing coupling compensation data during the vertical blank period.

The present disclosure further provides a method of driving a light emitting display device having a display panel including pixel lines having a plurality of pixels, the pixel lines being in a first area and a second area, the method comprising; performing image data writing driving for sequentially writing input image data to a plurality of pixel lines included in one of the first area or the second area; performing sensing data writing driving for writing sensing data to a pixel line included in the one of the first area or the second area during a vertical blank period in which image data writing driving is not performed; and compensating for a sensing deviation caused by coupling between horizontal lines and vertical lines in the display panel.

BRIEF DESCRIPTION OF THE DRAWINGS

The accompany drawings, which are included to provide a further understanding of the present disclosure and are incorporated on and constitute a part of this specification illustrate embodiments of the present disclosure and together with the description serve to explain the principles of the present disclosure.

FIGS. 16 and 17 are diagrams for describing a coupling phenomenon that may occur between lines arranged in horizontal and vertical directions.

FIGS. 18 and 19 are diagrams for describing a sensing deviation caused during a vertical blank period according to the coupling phenomenon described in FIGS. 16 and 17.

DETAILED DESCRIPTION

Reference will now be made in detail embodiments of the present disclosure examples of which are illustrated in the accompanying drawings.

Hereinafter, specific embodiments of the present disclosure will be described with reference to the attached drawings.

Although a pixel circuit and a gate driver formed on a substrate of a display panel which will be described below can be implemented as n-type metal oxide semiconductor field effect transistor (MOSFET) TFTs, the present disclosure is not limited thereto and may be implemented as p-type MOSFET TFTs. A TFT is a three-electrode element including a gate, a source and a drain. The source is an electrode that provides carriers to the transistor. In the TFT, carriers flow from the source. The drain is an electrode from which carriers flow to the outside of the TFT. That is, carriers flow from a source to a drain in a MOSFET. In the case of an n-type TFT (NMOS), a source voltage is lower than a drain voltage such that electrons can flow from the source to the drain because the electrons are carriers. Since electrons flow from the source to the drain in the n-type TFT, current flows from the drain to the source. On the other hand, In the case of a p-type TFT (PMOS), a source voltage is higher than a drain voltage such that holes can flow from the source to the drain because the holes are carriers. Since holes flow from the source to the drain in the p-type TFT, current flows from the source to the drain. It is noted that the source and the drain of the MOSFET are not fixed. For example, the source and the drain of the MOSFET may be changed according to an applied voltage. Accordingly, one of the source and drain will be described as a first electrode and the other will be described as a second electrode in embodiments of the present disclosure.

A light emitting display device will be described below focusing on an organic light emitting display device containing an organic light emitting material. However, the present disclosure is not limited thereto and may be applied to inorganic light emitting display containing an inorganic light emitting material.

In the following description, if a detailed description of known functions or configurations associated with the light emitting display device would unnecessarily obscure the gist of the present disclosure, detailed description thereof will be omitted.

Figure 1:
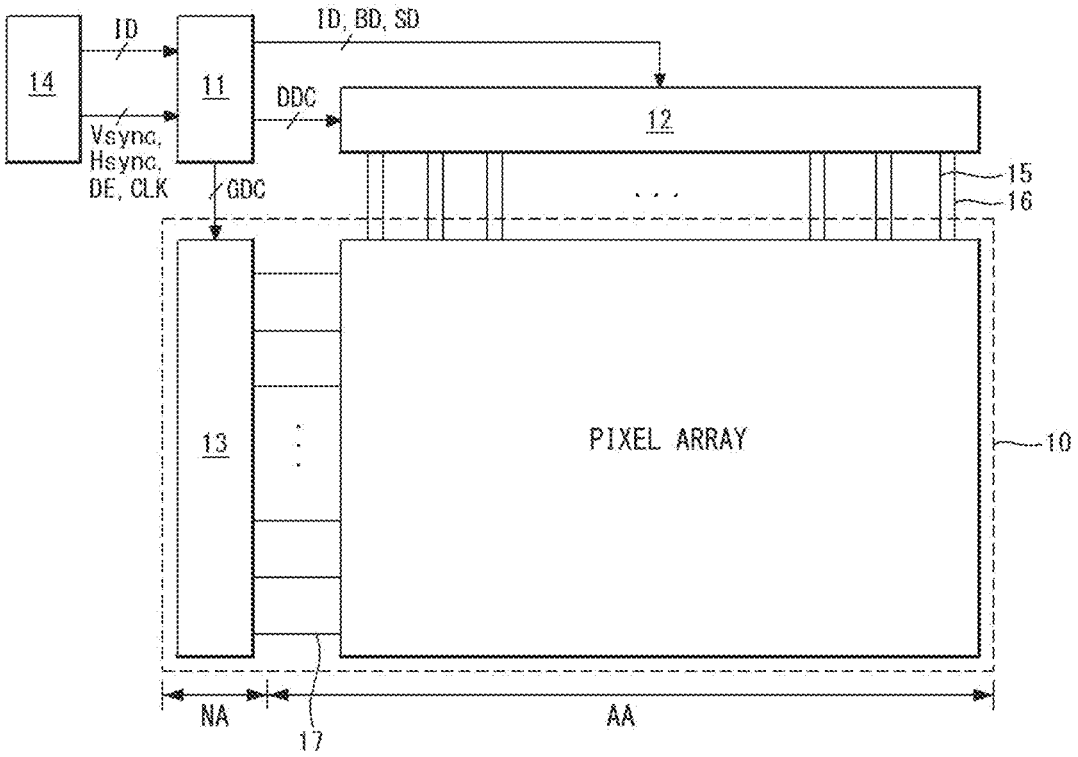
FIG. 1 is a diagram showing a light emitting display device according to an embodiment of the present disclosure.
Figure 2:
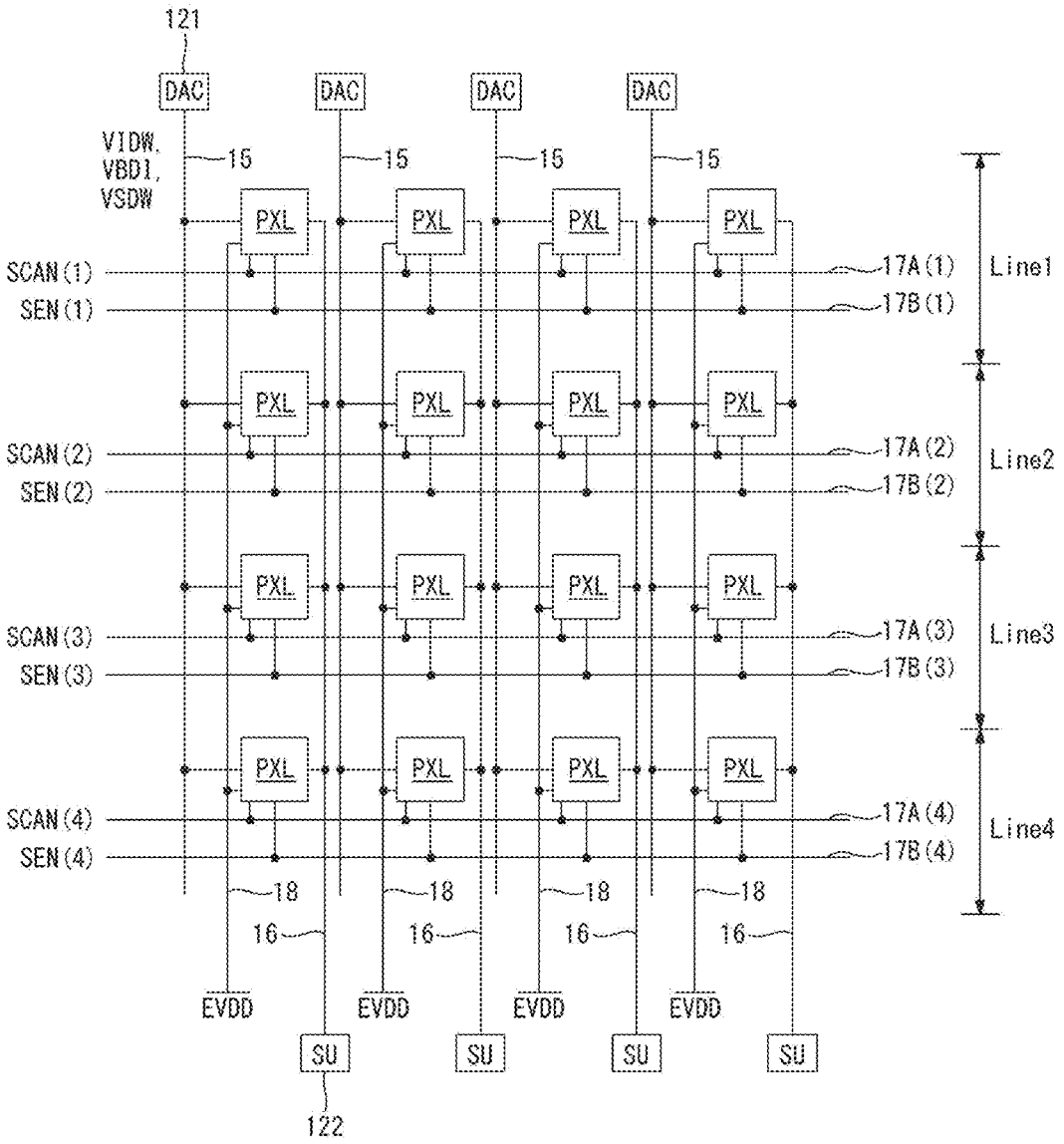
FIG. 2 is a diagram showing a pixel array included in the light emitting display device of FIG. 1.
Figure 3:
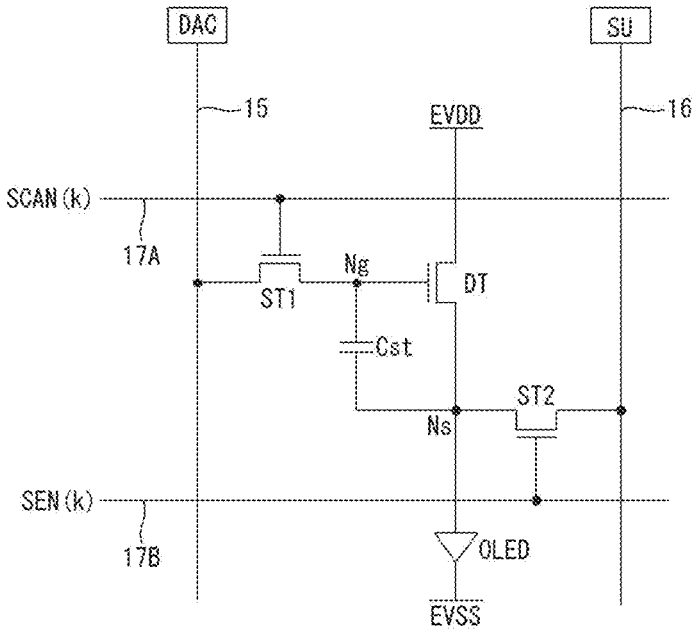
FIG. 3 is a diagram showing one of pixels included in the pixel array of FIG. 2.

FIG. 1 is a diagram showing a light emitting display device according to an embodiment of the present disclosure, FIG. 2 is a diagram showing a pixel array included in the light emitting display device of FIG. 1, and FIG. 3 is a diagram showing one of pixels included in the pixel array of FIG. 2.

As shown in FIGS. 1 to 3, the light emitting display device according to an embodiment of the present disclosure includes a display panel 10, a timing controller 11, and panel drivers 12 and 13. The panel drivers 12 and 13 includes a data driver 12 for driving data lines 15 of the display panel 10 and a gate driver 13 for driving gate lines 17 of the display panel 10.

The display panel 10 includes a plurality of data lines 15, reference voltage lines 16 and gate lines 17. Pixels PXL are disposed at intersections of the data lines 15, the reference voltage lines 16 and the gate lines 17. The pixels PXL form a pixel array in a display area AA of the display panel 10, as shown in FIG. 2.

The pixels PXL included in the pixel array may be divided per line on the basis of one direction. For example, the pixels PXL may be divided into a plurality of pixel lines Line 1 to Line 4 on the basis of a gate line extension direction (or horizontal direction). Here, a pixel line refers to a set of pixels PXL neighboring in the horizontal direction instead of a physical signal line. Accordingly, pixels PXL constituting the same pixel line can be connected to the same gate lines 17A and 17B.

Each pixel PXL can be connected to a digital-to-analog converter (hereinafter, DAC) 121 through the data line 15 and connected to a sensing unit (SU) 122 through the reference voltage line 16. The reference voltage line 16 may be further connected to the DAC 121 in order to provide a reference voltage. Although the DAC 121 and the sensing unit SU may be included in the data driver 12, the present disclosure is not limited thereto.

Each pixel PXL can be connected to a high-voltage pixel power supply EVDD through a power line 18. In addition, each pixel PXL can be connected to the gate driver 13 through the first and second gate lines 17A and 17B.

Each pixel PXL may be implemented as shown in FIG. 3. A pixel PXL disposed on a k-th (k is an integer) pixel line includes an OLED, a driving thin film transistor (TFT) DT, a storage capacitor Cst, a first switch TFT ST1 and a second switch TFT ST2, and the first switch TFT ST1 and the second switch TFT ST2 may be connected to the different gate lines 17A and 17B.

The OLED includes an anode connected to a source node Ns, a cathode connected to an input terminal of a low-voltage pixel power supply EVSS, and an organic compound layer disposed between the anode and the cathode. The driving TFT DT controls a driving current flowing through the OLED according to a voltage difference between a gate node Ng and the source node Ns. The driving TFT DT includes a gate electrode connected to the gate node Ng, a first electrode connected to the high-voltage pixel power supply EVDD, and a second electrode connected to the source node Ns. The storage capacitor Cst is connected between the gate node Ng and the source node Ns and stores a gate-source voltage of the driving TFT DT.

The first switch TFT ST1 causes a current to flow between the data line 15 and the gate node Ng according to a first gate signal SCAN(k) to apply a data voltage charged in the data line 15 to the gate node Ng. The first switch TFT ST1 includes a gate electrode connected to the first gate line 17A, a first electrode connected to the data line 15, and a second electrode connected to the gate node Ng. The second switch TFT ST2 causes a current to flow between the reference voltage line 16 and the source node Ns according to a second gate signal SEN(k) to apply a reference voltage charged in the reference voltage line 16 to the source node Ns or transmit a voltage variation at the source node Ns according to a pixel current to the reference voltage line 16. The second switch TFT ST2 includes a gate electrode connected to the second gate line 17B, a first electrode connected to the reference voltage line 16, and a second electrode connected to the source node Ns.

The number of gate lines connected to each pixel PXL may depend on a pixel structure. For example, the number of gate lines 17 connected to each pixel PXL is 2 in the case of a 2-scan pixel structure in which the first switch TFT ST1 and the second switch TFT ST2 are operated in different manners. In the 2-scan pixel structure, each gate line 17 includes the first gate line 17A to which a scan signal is applied and the second gate line 17B to which a sense signal is applied. Although the 2-scan pixel structure is exemplified in the following for convenience of description, the technical spirit of the disclosure is not limited to the pixel structure or the number of gate lines.

The timing controller 11 can generate a data control signal DDC for controlling operation timing of the data driver 12 and a gate control signal GDC for controlling operation timing of the gate driver 13 on the basis of timing signals such as a vertical synchronization signal Vsync, a horizontal synchronization signal Hsync, a dot clock signal DCLK and a data enable signal DE input from a host system 14. The gate control signal GDC may include a gate start signal, gate shift clocks, pixel line selection & cancellation signals, a sensing start timing indication signal, a sensing end timing indication signal, and the like. The data control signal DDC may include a source start pulse signal, a source sampling clock signal, a source output enable signal, and the like. The source start pulse signal controls a data sampling start timing of the data driver 12. The source sampling clock signal controls a sampling timing of data on the basis of a rising or falling edge thereof. The source output enable signal controls an output timing of the data driver 12.

The timing controller 11 can control a display driving timing and a sensing timing with respect to pixel lines of the display panel 10 on the basis of the timing control signals GDC and DDC such that driving characteristics of pixels can be sensed in real time during image display.

Here, sensing is an operation of writing sensing data SD to pixels PXL disposed in a predetermined pixel line to sense driving characteristics of the pixels PXL and updating a compensation value for compensating for driving characteristic variations of the pixels PXL on the basis of the sensing result. Hereinafter, an operation for writing sensing data SD to pixels PXL disposed in a predetermined pixel line in sensing is referred to as sensing data writing (SDW).

Display driving is an operation of starting to write input image data ID and black image data BD to pixel lines with a predetermined time difference within one frame to sequentially reproduce an input image and a black image on the display panel 10. Display driving includes image data writing (IDW) for writing input image data ID to pixel lines and black data insertion (BDI) for writing black image data BD to pixel lines. BDI can be started before IDW ends within one frame such that a display device optimized for high-speed operation can be realized. That is, IDW for a first pixel line and BDI for a second pixel line may temporarily overlap within one frame.

The timing controller 11 can adjust a time difference between IDW start timing and BDI start timing, that is, an emission duty, by controlling the BDI start timing within one frame. Since BDI overlaps with IDW, data collision is an important issue in adjustment of an emission duty. Various embodiments of adjusting an emission duty while preventing data collision will be described later with reference to FIGS. 16 to 23.

The timing controller 11 can control BDI start timing within one frame in connection with motion of input image data ID. The timing controller 11 can detect motion of the input image data ID through various known video processing techniques and then advance the BDI start timing within one frame when a motion variation in the input image data ID is large, to thereby reduce the emission duty. Accordingly, MPRT performance can be improved and motion blurring can be alleviated when an abrupt image change occurs. On the other hand, when there is no image change, a maximum instantaneous luminance of pixels can be reduced by delaying the BDI starting timing and increasing the emission duty.

The timing controller 11 can perform IDW in a vertical active period of one frame and perform SDW in a vertical blank period in which IDW is not performed. The timing controller 11 can perform BDI using both the vertical active period and the vertical blank period. Accordingly, BDI timing can overlap with IDW timing in the vertical active period and overlap with SDW timing in the vertical blank period.

The timing controller 11 outputs gate shift clocks including a carry clock signal, a scan clock signal and a sense clock signal, and a gate start signal to the gate driver 13 for IDW/BDI/SDW. The timing controller 11 may divide the gate shift clocks into a clock group A and a clock group B having different phases and control the operation of the gate driver 13 on the basis of the clock group A and the clock group B to divide the pixel array into at least one area A and at least one area B and separately drive the pixel array in order to prevent data collision between IDW and BDI. The clock group A is input to stages A of the gate driver 13 which are connected to pixel lines of the area A and the clock group B is input to stages B of the gate driver 13 which are connected to pixel lines of the area B. The clock group A and the clock group B may include IDW/SDW carry clock signals, BDI carry clock signals, IDW/SDW scan clock signals, BDI scan clock signals, and IDW/SDW sense clock signals (refer to FIGS. 9 to 12).

The IDW/SDW carry clock signals and the BDI carry clock signals are input to the gate driver 13 through the same carry clock signal lines and the IDW/SDW scan clock signals and the BDI scan clock signals are input to the gate driver 13 through the same scan clock signal lines on the basis of one stage of the gate driver 13.

The timing controller 11 can control IDW and BDI such that they are separately performed in the area A and the area B while causing a pulse period (on voltage operation) of the BDI scan clock signals and a pulse period of the IDW/SDW scan clock signals not to overlap with each other. In other words, the timing controller 11 can cause BDI for the area B to be performed while IDW for the area A is performed and cause IDW for the area B to be performed while BDI for the area A is performed. Accordingly, undesirable data mixing (i.e., data collision) between input image data ID and black image data BD can be prevented in a technique for improving MPRT performance by inserting a black image.

The timing controller 11 may alternately output BDI scan clock signals of the clock group A and BDI scan clock signals of the clock group B at least once within one clock cycle while simultaneously or concurrently outputting a predetermined number of BDI scan clock signals of the same clock group. Accordingly, an insertion time of the black image data BD can be reduced and a sufficient write time of the input image data ID can be secured in the technique for improving the MPRT performance.

The timing controller 11 may further output the pixel line selection & cancellation signals, the sensing start timing indication signal and the sensing end timing indication signal to the gate driver 13 in addition to the gate shift clocks such that SDW for a predetermined pixel line which is a sensing target can be performed.

The timing controller 11 may divide the pixel line selection & cancellation signals into a pixel line selection & cancellation signal A and a pixel line selection & cancellation signal B which have different phases, input the pixel line selection & cancellation signal A to stages of the gate driver 13 which are connected to pixel lines of the area A and input the pixel line selection & cancellation signal B to stages of the gate driver 13 which are connected to pixel lines of the area B in order to prevent data collision between SDW and BDI. In addition, the timing controller 11 may selectively activate one of the pixel line selection & cancellation signal A and the pixel line selection & cancellation signal B to an on voltage, activate only the pixel line selection & cancellation signal B such that SDW is performed only for the area B when BDI is performed for the area A, and activate only the pixel line selection & cancellation signal A such that SDW is performed only for the area A when BDI is performed for the area B. Consequently, undesirable data mixing between sensing data SD and black image data BD can be prevented and pixel driving characteristics can be sensed more accurately in the technique for improving the MPRT performance by inserting a black image.

The timing controller 11 outputs input image data ID input from the host system 14 to the data driver 12. The timing controller 11 outputs black image data BD which has been internally generated (or predetermined values) and sensing data SD to the data driver 12. The black image data BD corresponds to lowest grayscale data of the input image data ID and is used to display a black image during BDI. The sensing data SD is used to cause a predetermined pixel current to flow through pixels PXL of a pixel line that is a sensing target during SDW. Sensing data SD to be written to R, G and B pixels PXL may be identical or may be different.

The gate driver 13 generates a scan signal SCAN and a sense signal SEN on the basis of the gate control signal DDC from the timing controller 11. The gate driver 13 generates an IDW/SDW scan signal SCAN on the basis of the IDW/SDW carry clock signals and the IDW/SDW scan clock signals and generates a BDI scan signal SCAN on the basis of the BDI carry clock signals and the BDI scan clock signals. In addition, the gate driver 13 generates an IDW/SDW sense signal SEN on the basis of the IDW/SDW carry clock signals and the IDW/SDW sense clock signals.

To perform IDW and SDW, the gate driver 13 simultaneously provides the BDI scan signal SCAN to a predetermined number of first gate lines 17A in the area B (or area A) while sequentially providing the IDW/SDW scan signal SCAN to first gate lines 17A of the area A (or area B). In addition, the gate driver 13 sequentially provides the IDW/SDW sense signal SEN to second gate lines 17B of the area A (or area B) in synchronization with a timing at which the IDW/SDW scan signal SCAN is provided to the first gate lines 17A of the area A (or area B).

To perform SDW, the gate driver 13 provides an IDW/SDW scan signal SCAN having double pulse periods to a first gate line 17A of the area A (or area B) and provides the IDW/SDW sense signal SEN to a second gate line 17B of the area A (or area B). Here, the first and second gate lines 17A and 17B are gate lines connected to the same sensing target pixel line.

The gate driver 13 may be embedded in a non-display area NA of the display panel 10 according to a gate driver in panel (GIP) structure.

The data driver 12 includes a plurality of DACs 121 and a plurality of sensing units (SU) 122. The DACs 121 convert input image data ID into IDW data voltages VIDW, convert black image data BD into BDI data voltages VBDI and convert sensing data SD into SDW data voltages VSDW on the basis of the data control signal DDC from the timing controller 11. In addition, the DACs 121 generate reference voltages to be applied to the pixels PXL.

To perform IDW and BDI, the DACs 121 output the IDW data voltages VIDW to the data lines 15 in synchronization with the IDW/SDW scan signal SCAN, output the BDI data voltages VBDI to the data lines 15 in synchronization with the BDI scan signal SCAN, and output the reference voltages to the reference voltage lines 16 in synchronization with the IDW/SDW sense signal SEN.

To perform SDW, the DACs 121 output the SDW data voltages VSDW to the data lines 15 in synchronization with a first pulse of the IDW/SDW scan signal SCAN and output the reference voltages to the reference voltage lines 16 in synchronization with the IDW/SDW sense signal SEN, to set up a sensing target pixel line. The SUs 122 sense pixel current flowing through pixels PXL of the sensing target pixel line through the reference voltage lines 16. After sensing ends, the DACs 121 output SDW recovery voltages to the data lines 15 in synchronization with a second pulse of the IDW/SDW scan signal SCAN to restore a display state of the sensing target pixel line to the display state immediately before sensing. The SDW recovery voltages may be the IDW data voltages VIDW or the BDI data voltages.

Figure 4:
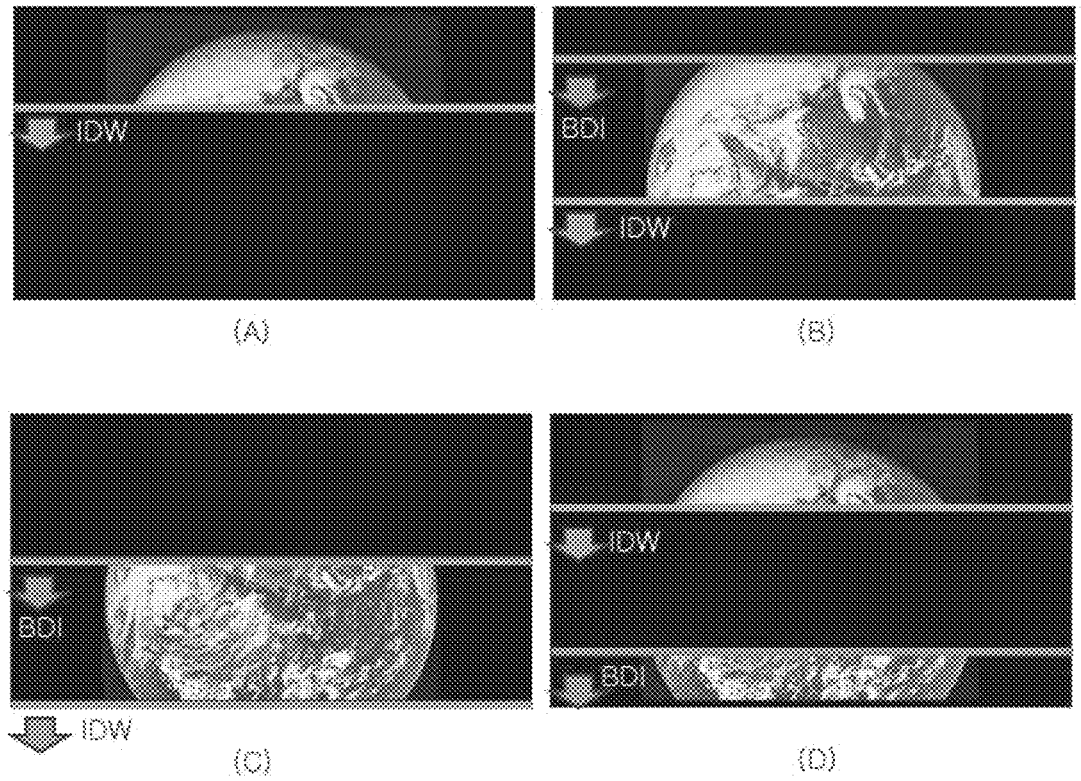
FIGS. 4 to 6 are diagrams showing a black image insertion technique applied to the light emitting display device of FIG. 1.
Figure 5:
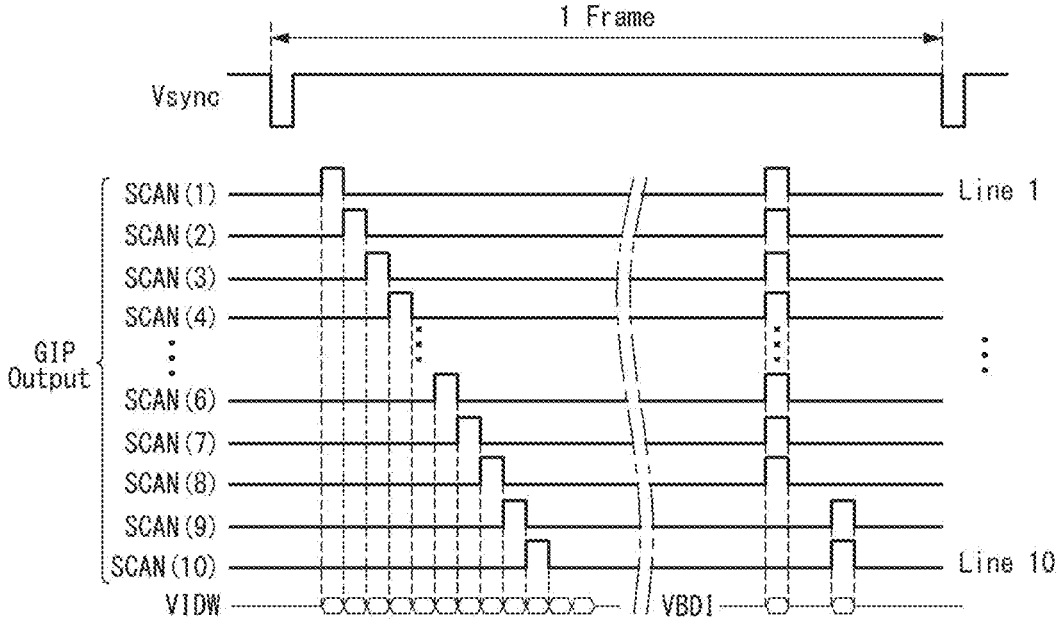
Figure 6:
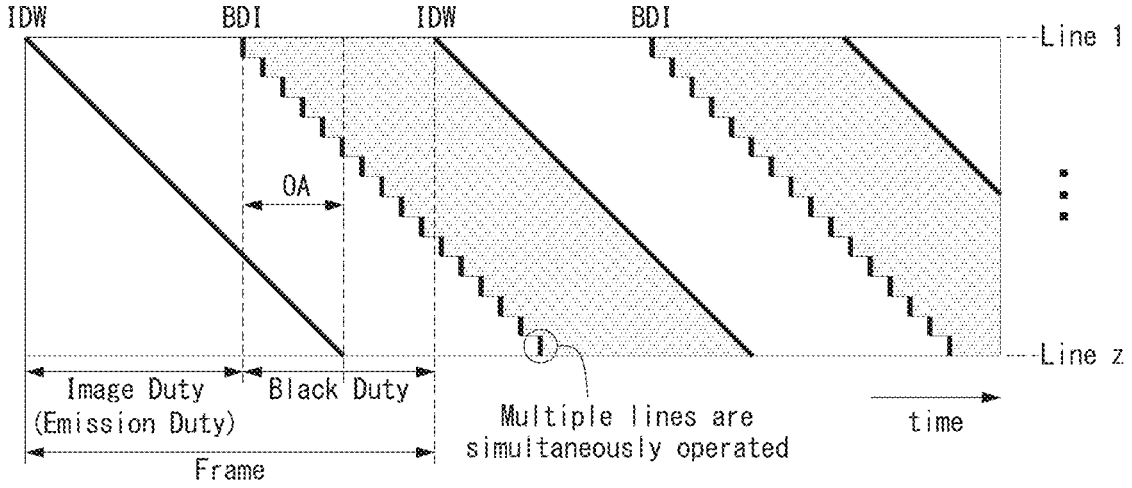

FIGS. 4 to 6 are diagrams showing a black image insertion technique applied to the light emitting display device of FIG. 1.

As shown in FIG. 4, IDW and BDI are consecutively performed with a predetermined time difference therebetween within one frame on the basis of the same pixel line. An emission duty of pixels PXL is determined by a time difference between IDW start timing and BDI start timing within the same frame. The IDW start timing is a fixed factor, whereas the BDI start timing is an adjustable design factor. The IDW start timing is determined by a first pulse of the gate start signal and the BDI start timing is determined by a second pulse of the gate start signal which is phase-delayed from the first pulse. Accordingly, the emission duty of the pixels PXL can be controlled by advancing or delaying an output timing of the second pulse of the gate start signal to adjust the BDI start timing. In other words, the emission duty of the pixels PXL increases and a black duty decreases when the aforementioned time difference is increased by delaying the output timing of the second pulse of the gate start signal, whereas the emission duty of the pixels PXL decreases and the black duty increases when the time difference is reduced by advancing the output timing of the second pulse. When the emission duty of the pixels PXL is determined in this manner, the emission duty is maintained irrespective of frame change. That is, IDW timing and BDI timing for pixel lines are equally shifted while the emission duty is maintained over time.

As shown in FIG. 5, an IDW/SDW scan signal SCAN and a BDI scan signal SCAN are output with a predetermined time difference corresponding to the emission duty therebetween within one frame. In FIG. 5, the IDW/SDW sense signal SEN is omitted for convenience of description. IDW/SDW scan signals SCAN(1) to SCAN(10) are phase-shifted line sequentially to select pixel lines Line 1 to Line 10 one by one, and IDW data voltages VIDW are sequentially applied to the selected pixel lines Line 1 to Line 10. BDI scan signals SCAN (1) to SCAN (10) are phase-shifted block sequentially to simultaneously select a plurality of pixel lines among the pixel lines Line 1 to Line 10, and BDI data voltages VBDI are simultaneously applied to the pixel lines Line 1 to Line 10 of a selected block.

As shown in FIG. 6, even if IDW timing and BDI timing for pixel lines Line 1 to Line z change, they can be shifted while maintaining the emission duty. When this driving concept is employed, additional frames for BDI need not be provided and thus it is not necessary to increase a frame rate.

However, since the IDW timing precedes the BDI timing by the emission duty and the IDW timing and the BDI timing have substantially the same shift rate, an overlap period OA in which IDW for a first pixel line and BDI for a second pixel line overlap is necessarily generated. Since two pixel lines are driven in an overlap manner in the overlap period OA, data collision (or data mixing) may occur.

Figure 7:
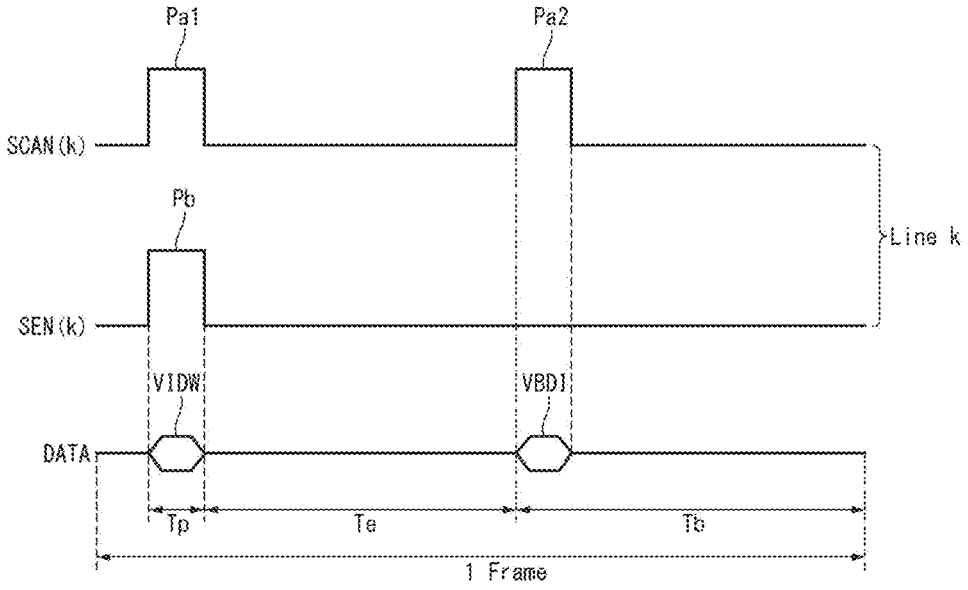
FIG. 7 is a timing diagram of a gate signal and a data signal for performing IDW and BDI of FIG. 6 in a k-th pixel line.
Figure 8A:
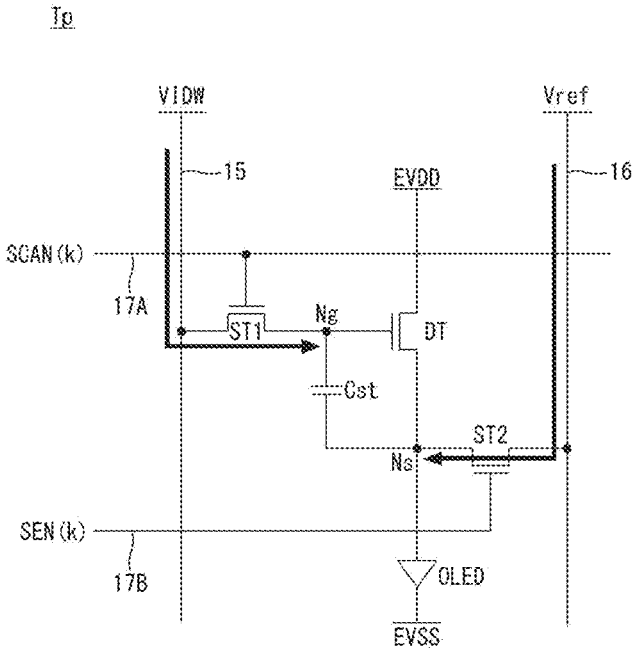
FIG. 8A is an equivalent circuit diagram of a pixel corresponding to a programming period of FIG. 7.
Figure 8B:
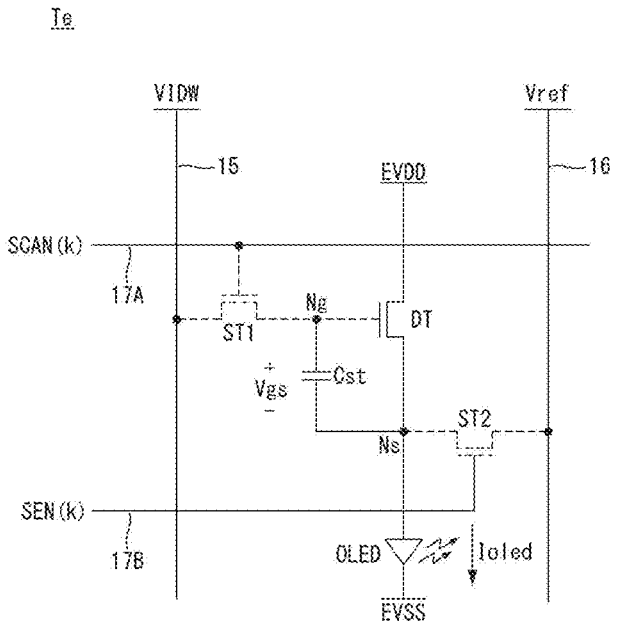
FIG. 8B is an equivalent circuit diagram of the pixel corresponding to an emission period of FIG. 7.
Figure 8C:
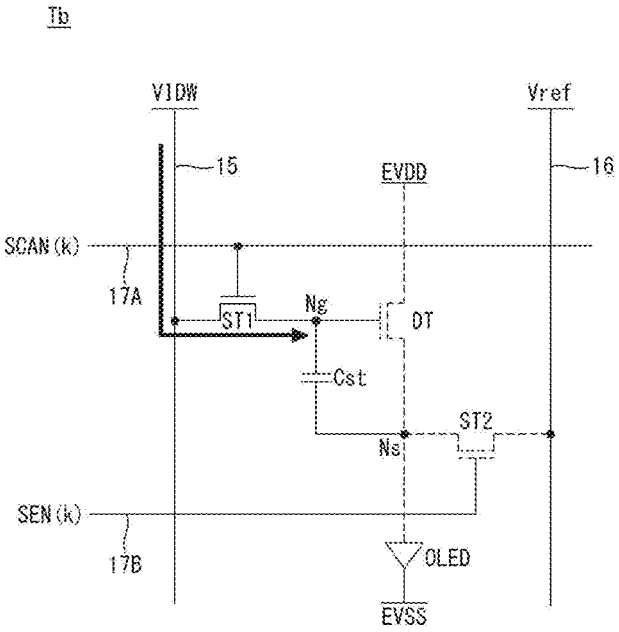
FIG. 8C is an equivalent circuit diagram of the pixel corresponding to a black period of FIG. 7.

FIG. 7 is a timing diagram of a gate signal and a data signal for performing IDW and BDI of FIG. 6 in a k-th pixel line, FIG. 8A is an equivalent circuit diagram of a pixel corresponding to a programming period of FIG. 7, FIG. 8B is an equivalent circuit diagram of the pixel corresponding to an emission period of FIG. 7, and FIG. 8C is an equivalent circuit diagram of the pixel corresponding to a black period of FIG. 7.

FIG. 7 shows IDW/BDI for a pixel of the k-th pixel line Line k. Referring to FIG. 7, one frame for IDW/BDI includes a programming period Tp in which a voltage between a gate node Ng and a source node Ns is set to be suited to a pixel current for grayscale representation, an emission period Te in which an OLED emits light, and a black period Tb in which light emission of the OLED is stopped. The emission duty may correspond to the emission period Te and the black duty may correspond to the black period Tb. In FIG. 7, the IDW scan signal SCAN is denoted by Pa1, the BDI scan signal SCAN is denoted by Pa2, and the IDW sense signal SEN is denoted by Pb.

Referring to FIGS. 7 and 8A, a first switch TFT ST1 of a pixel is turned on according to the IDW scan signal Pa1 to apply an IDW data voltage VIDW to the gate node Ng in the programming period Tp. A second switch TFT ST2 of the pixel is turned on according to the IDW sense signal Pb to apply a reference voltage Vref to the source node Ns in the programming period Tp. Accordingly, a voltage between the gate node Ng and the source node Ns of the pixel is set to be suited to a desired pixel current in the programming period Tp.

Referring to FIGS. 7 and 8B, the first switch TFT ST1 and the second switch TFT ST2 of the pixel are turned off in the emission period Te. The voltage Vgs between the gate node Ng and the source node Ns which has been preset in the pixel is maintained in the emission period Te. Since the voltage Vgs between the gate node Ng and the source node Ns is higher than the threshold voltage of a driving TFT DT of the pixel, a pixel current Ioled flows through the driving TFT DT of the pixel during the emission period Te. The electric potential of the gate node Ng and the electric potential of the source node Ns are boosted by the pixel current Ioled while the voltage Vgs between the gate node Ng and the source node Ns is maintained in the emission period Te. When the electric potential of the source node Ns is boosted to the operating point level of an OLED, the OLED of the pixel emits light.

Referring to FIGS. 7 and 8C, the first switch TFT ST1 of the pixel is turned on according to the BDI scan signal Pa2 to apply a BDI data voltage VBDI to the gate node Ng in the black period Tb. Since the second switch TFT ST2 of the pixel maintains a turn-off state in the black period Tb, the electric potential of the source node Ns maintains the operating point level of the OLED. The BDI data voltage VBDI is lower than the operating point level of the OLED. Accordingly, the voltage Vgs between the gate node Ng and the source node Ns is lower than the threshold voltage of the driving TFT DT in the black period Tb, and thus the pixel current Ioled does not flow through the driving TFT DT of the pixel and the OLED stops light emission.

Figure 9:
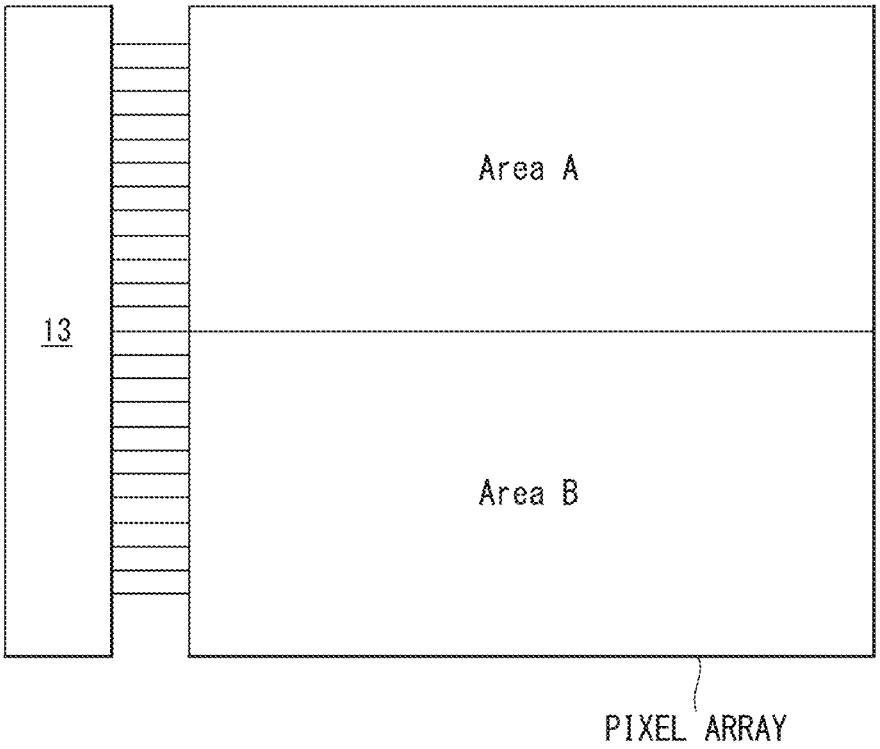
FIGS. 9, 10A and 10B are diagrams showing an example of dividing a pixel array into an area A and an area B and separately driving the pixel array on the basis of phase-separated clock groups A and B.
Figure 10A:
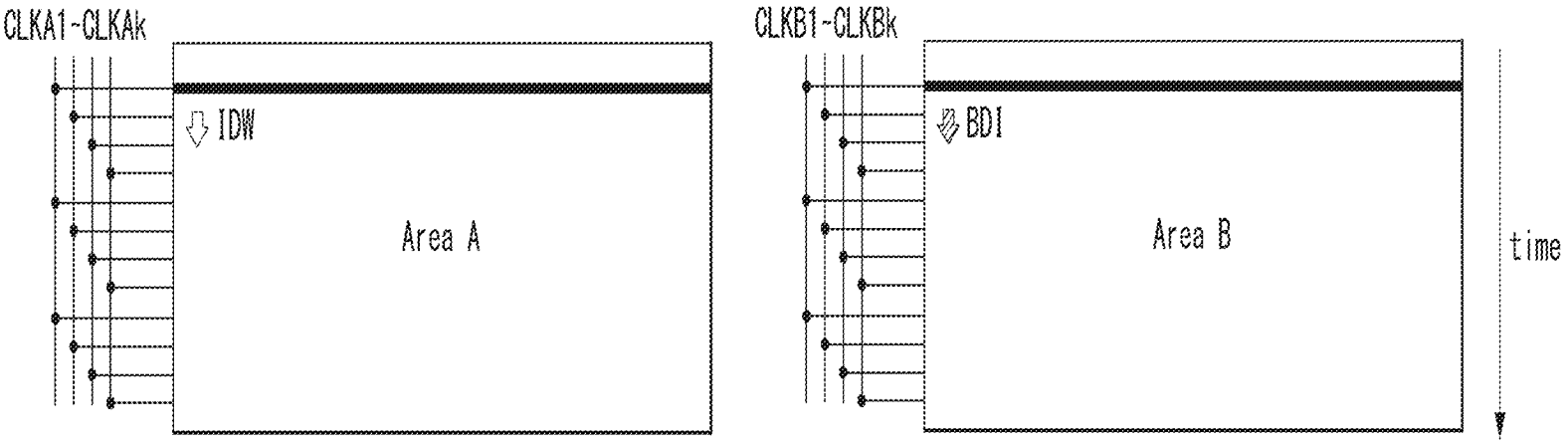
Figure 10B:
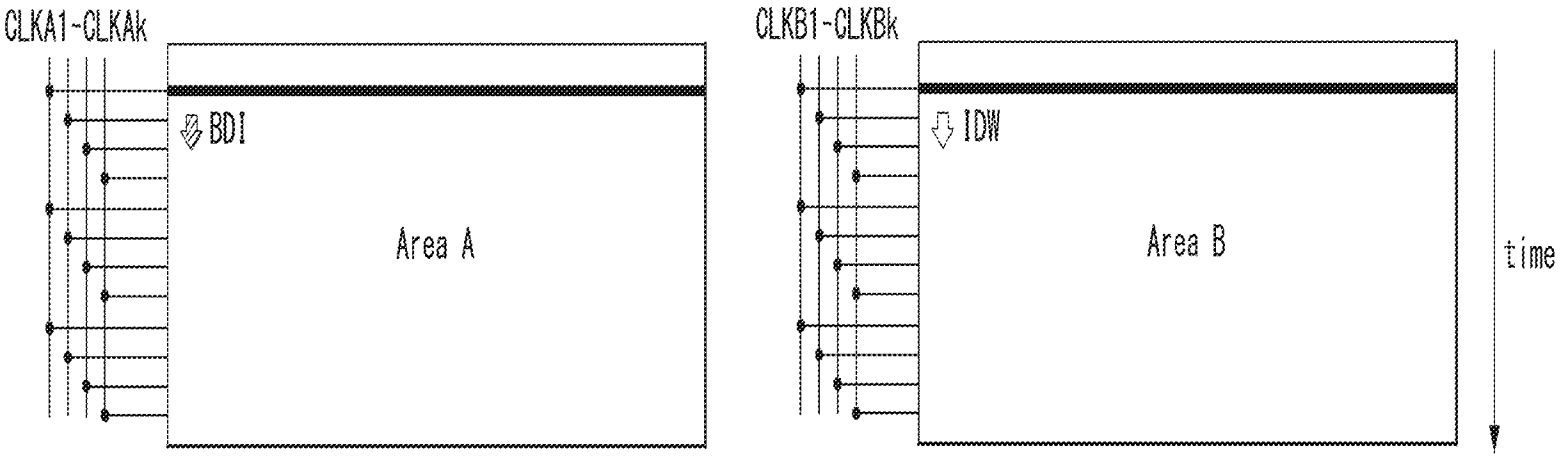

FIGS. 9, 10A and 10B are diagrams showing an example of dividing a pixel array into an area A and an area B and separately driving the pixel array on the basis of phase-separated clock groups A and B.

Since two pixel lines area driven in an overlap manner in the overlap period OA of FIG. 6, data collision (or data mixing) may occur. To prevent such data collision, an embodiment of the present disclosure may classify gate shift clocks into a clock group A CLKA1 to CLKAk and a clock group B CLKB1 to CLKBk, divide the pixel array into an area A corresponding to an upper part of the screen and an area B corresponding to a lower part of the screen and separately drive the pixel array, as shown in FIGS. 9, 10A and 10B.

In the gate driver 13, the clock group A CLKA1 to CLKAk is input to stages that drive gate lines of the area A and the clock group B CLKB1 to CLKBk is input to stages that drive gate lines of the area B. The stages that drive the gate lines of the area A output gate signals for IDW according to the first pulse of the gate start signal and output gate signals for BDI according to the second pulse of the gate start signal. Stages of the gate driver 13 may be connected in a cascade manner such that pixel lines of the area A of the upper part of the screen and the area B of the lower part of the screen are sequentially driven.

The uppermost pixel line of the area B is driven after the lowest pixel line of the area A. The second pulse of the gate start signal is applied to the area A at a point in time at which IDW according to the first pulse of the gate start signal is started in the area B, and the first pulse of the gate start signal is applied to the area A at a point in time at which BDI according to the second pulse of the gate start signal is started in the area B. Accordingly, BDI according to the second pulse can be simultaneously performed in the area B when IDW according to the first pulse is performed in the area A, and BDI according to the second pulse can be simultaneously performed in the area A when IDW according to the first pulse is performed in the area B.

The light emitting display device according to the present disclosure can simultaneously perform IDW for the area A according to the clock group A CLKA1 to CLKAk and BDI for the area B according to the clock group B CLKB1 to CLKBk, as shown in FIG. 10A. In addition, the light emitting display device according to the present disclosure can simultaneously perform BDI for the area A according to the clock group A CLKA1 to CLKAk and IDW for the area B according to the clock group B CLKB1 to CLKBk, as shown in FIG. 10B.

Since the phases of the clock group A CLKA1 to CLKAk and the clock group B CLKB1 to CLKBk are separated, a write timing of an IDW data voltage VIDW (or a write timing of a BDI data voltage VBDI) for the first pixel line of the area A does not temporarily overlap with a write timing of a BDI data voltage VBDI (or a write timing of an IDW data voltage VIDW) for the second pixel line of the area B and mixing of the data voltages VBDI and VIDW does not occur. However, when the pixel array is divided into two upper and lower areas A and B and driven, an emission duty of 50% can be achieved.

Figure 11:
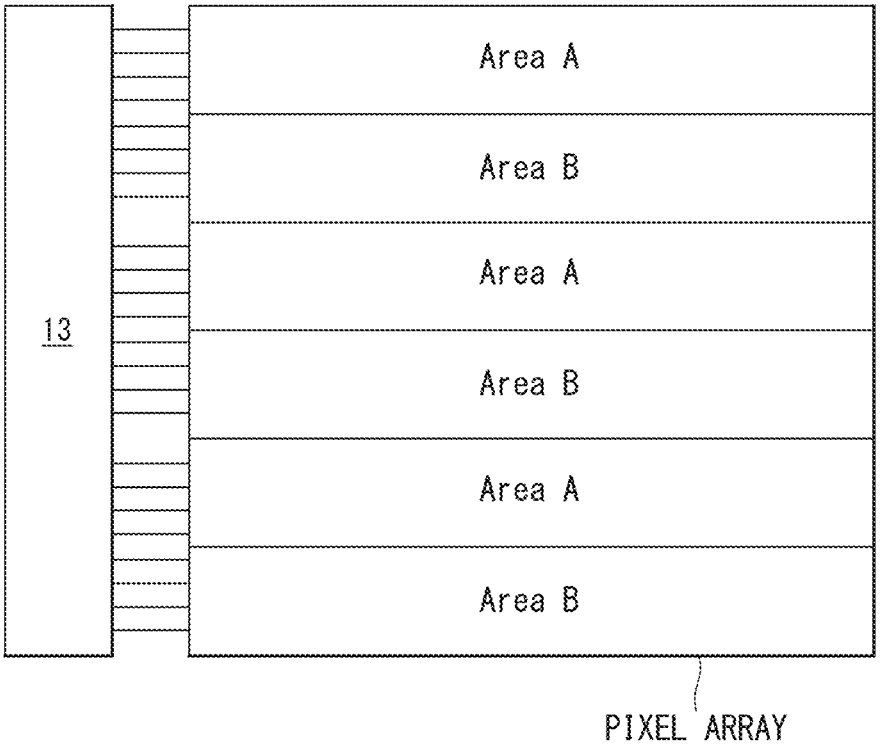
FIGS. 11 and 12 are diagrams showing an example of dividing a pixel array into a plurality of areas A and a plurality of areas B and separately driving the pixel array on the basis of the phase-separated clock groups A and B.
Figure 12:
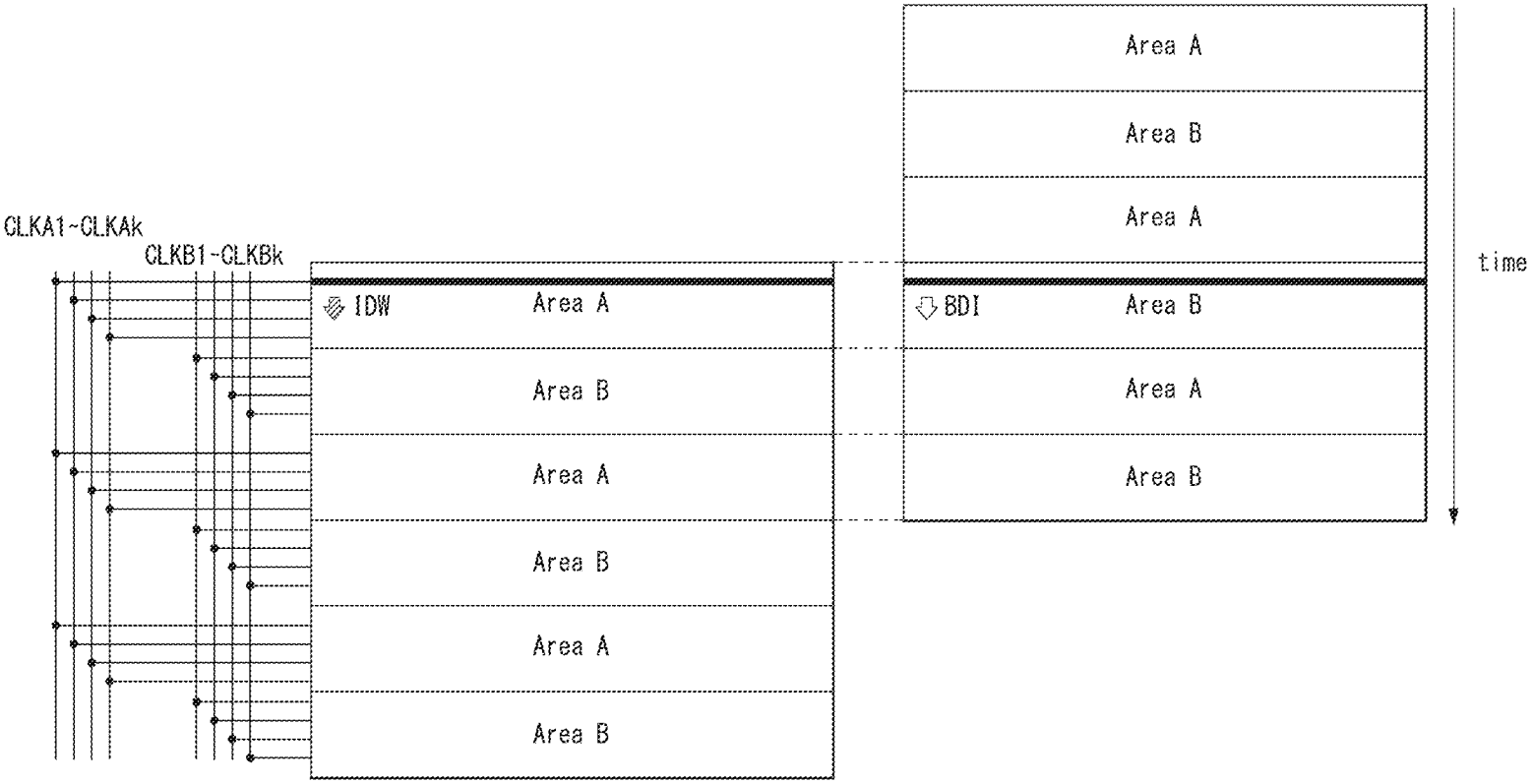

FIGS. 11 and 12 are diagrams showing an example of dividing a pixel array into a plurality of areas A and a plurality of areas B and separately driving the pixel array on the basis of phase-separated clock groups A and B.

In FIG. 11, a plurality of areas A and a plurality of areas B may be alternately arranged, and when the pixel array is divided into the areas A and the areas B and driven on the basis of this arrangement, a degree of freedom for design for adjusting an emission duty ratio is improved.

In the gate driver 13 shown in FIG. 11, the clock group A CLKA1 to CLKAk shown in FIG. 12 is input to stages that drive gate lines of the areas A and the clock group B CLKB1 to CLKBk shown in FIG. 12 is input to stages that drive gate lines of the areas B. The stages are connected in a cascade manner such that pixel lines are sequentially driven on all boundaries of the areas A and the areas B.

In FIG. 12, write timings of IDW data voltages VIDW are sequentially shifted from the uppermost area A of the pixel array according to the clock group A CLKA1 to CLKAk and the first pulse of the gate start signal, and at the same time, write timings of BDI data voltages VBDI are sequentially shifted from an area B in the middle of the pixel array according to the clock group B CLKB1 to CLKBk and the second pulse of the gate start signal. When the second pulse of the gate start signal is applied at a point in time at which IDW according to the first pulse of the gate start signal starts in a certain area A, the aforementioned operation can be performed. Further, when the first pulse of the gate start signal is applied at a point in time at which BDI according to the second pulse of the gate start signal starts in a certain area B, the aforementioned operation can be performed.

Figure 13:
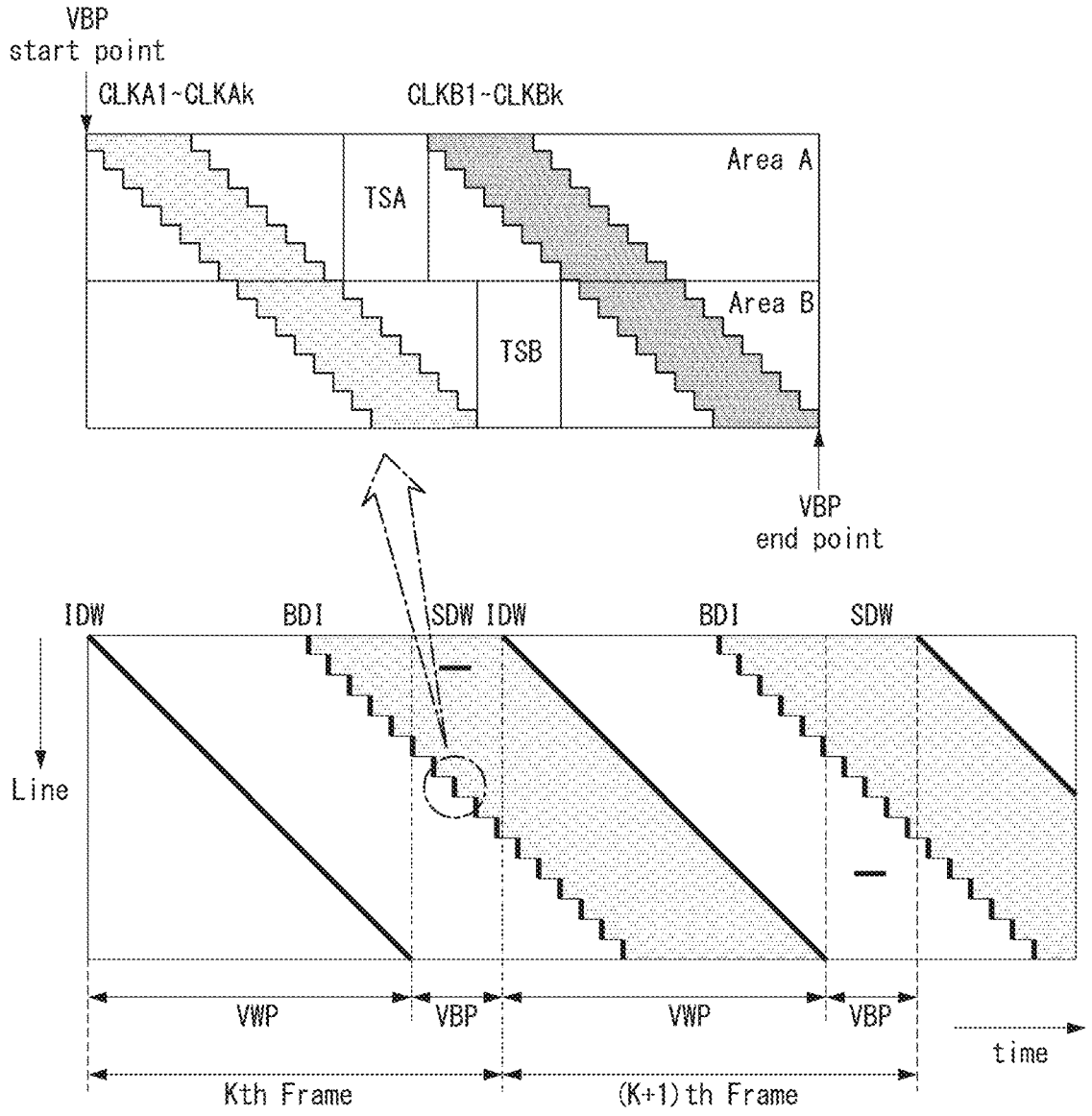
FIG. 13 is a diagram showing real-time sensing during a vertical blank period in the black image insertion technique.
Figure 14:
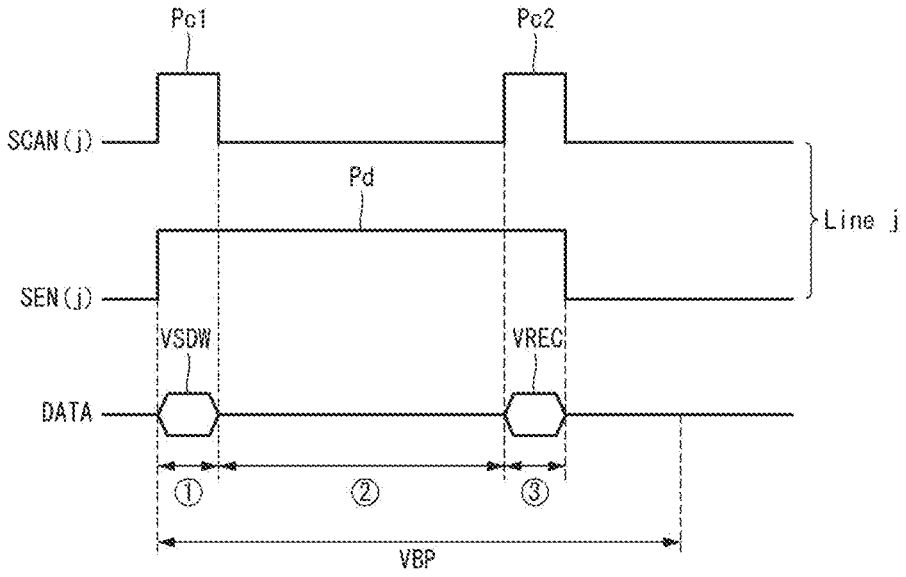
FIG. 14 is a timing diagram of a gate signal and a data signal for real-time sensing of FIG. 13.
Figure 15A:
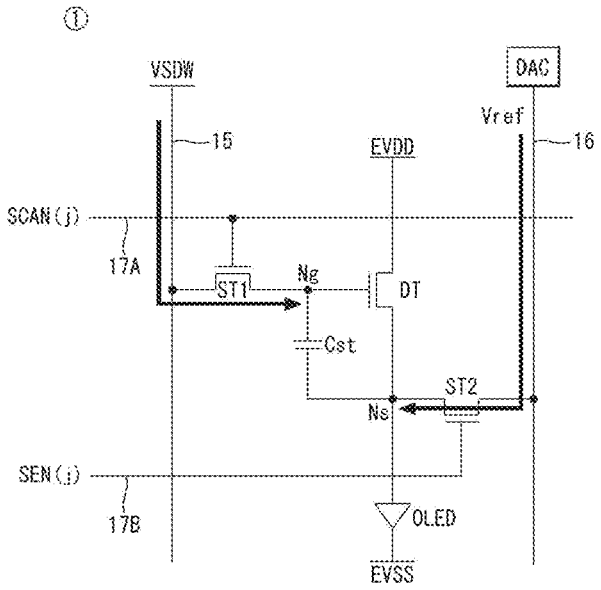
FIG. 15A is an equivalent circuit diagram of a pixel corresponding to a setup period of FIG. 13.
Figure 15B:
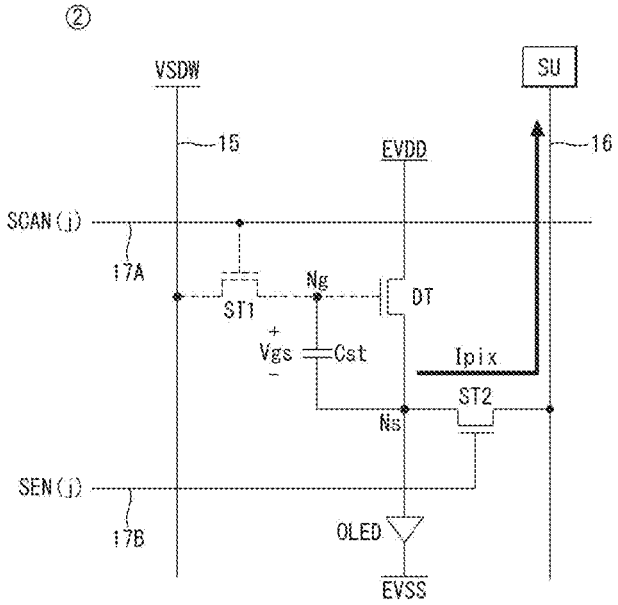
FIG. 15B is an equivalent circuit diagram of the pixel corresponding to a sensing period of FIG. 13.
Figure 15C:
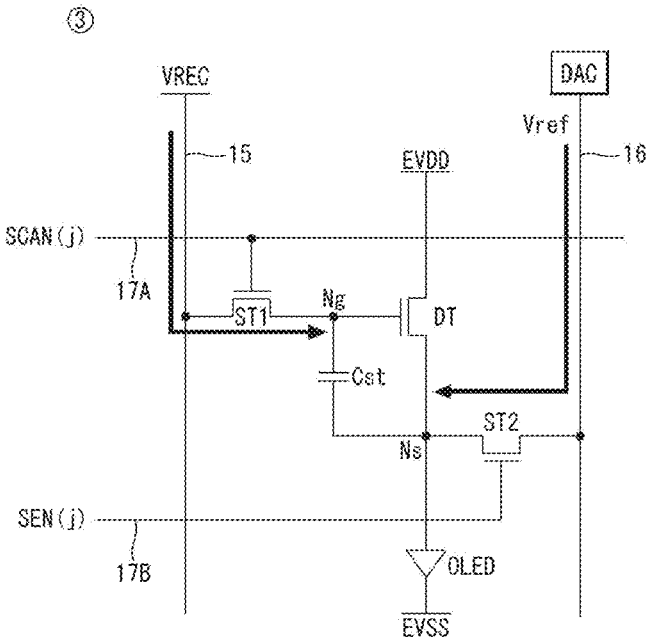
FIG. 15C is an equivalent circuit diagram of the pixel corresponding to a reset period of FIG. 13.

FIG. 13 is a diagram showing real-time sensing during a vertical blank period in the black image insertion technique, FIG. 14 is a timing diagram of a gate signal and a data signal for real-time sensing of FIG. 13, FIG. 15A is an equivalent circuit diagram of a pixel corresponding to a setup period of FIG. 13, FIG. 15B is an equivalent circuit diagram of the pixel corresponding to a sensing period of FIG. 13, and FIG. 15C is an equivalent circuit diagram of the pixel corresponding to a reset period of FIG. 13.

As shown in FIG. 13, the timing controller 11 can cause IDW to be performed within a vertical active period VWP of each frame and cause SDW to be performed within a vertical blank period VBP of each frame on the basis of the timing control signals GDC and DDC. In addition, the timing controller 11 can cause BDI to be performed in a part of a vertical active period VWP of a k-th frame and a vertical blank period VBP of a k-th frame and a part of a vertical active period VWP of a (k+1)-th frame. A time allocated to BDI for all pixel lines may be substantially the same as the duration of the vertical active period VWP. Since the vertical blank period VBP is much shorter than the vertical active period VWP, SDW for a predetermined pixel line can be performed within a much shorter time compared to IDW and BDI.

As can be ascertained through the enlarged view shown in the upper part of FIG. 13, the clock group A CLKA1 to CLKAk present in the vertical blank period VBP can be defined as clocks for BDI and the clock group B CLKB1 to CLKBk can be defined as clocks for IDW or SDW. Since the clock group A CLKA1 to CLKAk and the clock group B CLKB1 to CLKBk should be simultaneously applied even in the vertical blank period VBP, the clocks are divided into first half and last half for operations, as shown in the enlarged view. When the clock groups are divided in this manner, sensing available time is also divided into a first-half sensing available time TSA and a last-half sensing available time TSB. When the clocks are divided into the first half and the last half for operations, if the clock group A CLKA1 to CLKAk and the clock group B CLKB1 to CLKBk overlap, problems caused thereby are generated. Accordingly, sensing time is divided into two, and a sensing available time becomes shorter than that before the sensing time is divided into two.

FIG. 14 shows SDW for a pixel of a j-th pixel line Line j. As shown in FIGS. 14, 15A, 15B and 15C, a vertical blank period VBP for SDW includes a setup period ① in which the voltage between the gate node Ng and the source node Ns is set to be suited to sensing pixel current, a sensing period ② in which pixel current is sampled, and a reset period ③ in which the voltage between the gate node Ng and the source node Ns is restored to the voltage immediately before the setup period ①. In FIG. 14, SDW scan signals SCAN are denoted by Pc1 and Pc2 and an SDW sensing signal SEN is denoted by Pd.

As shown in FIGS. 13, 14 and 15A, the first switch TFT ST1 of the pixel is turned on according to the SDW scan signal Pc1 to apply an SDW data voltage VSDW to the gate node Ng in the setup period ①. The second switch TFT ST2 of the pixel is turned on according to the SDW sense signal Pd to apply a reference voltage Vref to the source node Ns in the setup period ①. Accordingly, the voltage between the gate node Ng and the source node Ns is set to be suited to sensing pixel current in the setup period ①.

As shown in FIGS. 13, 14 and 15B, the first switch TFT ST1 of the pixel is turned off and the second switch TFT ST2 maintains a turn-on state in the sensing period ②. In addition, the reference voltage line 16 is connected to the sensing unit SU from the DAC. The sensing unit SU samples a sensing pixel current Ipix input through the second switch TFT ST2 and the reference voltage line 16 in the sensing period ②.

As shown in FIGS. 13, 14 and 15C, the first switch TFT ST1 of the pixel is turned on according to the SDW scan signal Pc to apply a recovery data voltage VREC to the gate node Ng in the reset period ③. The recovery data voltage VREC may be an IDW data voltage or a BDI data voltage. If the IDW data voltage is maintained in the corresponding pixel line immediately before SDW operation, the recovery data voltage VREC becomes the IDW data voltage. On the other hand, if the BDI data voltage is maintained in the corresponding pixel line immediately before SDW operation, the recovery data voltage VREC becomes the BDI data voltage. The reference voltage line 16 is connected to the DAC again and the second switch TFT ST2 of the pixel is turned on according to the SDW sense signal Pd to apply the reference voltage Vref to the source node Ns in the reset period ③. Accordingly, the voltage between the gate node Ng and the source node Ns of the pixel is restored to the state immediately before SDW operation in the reset period ③.

Figure 16:
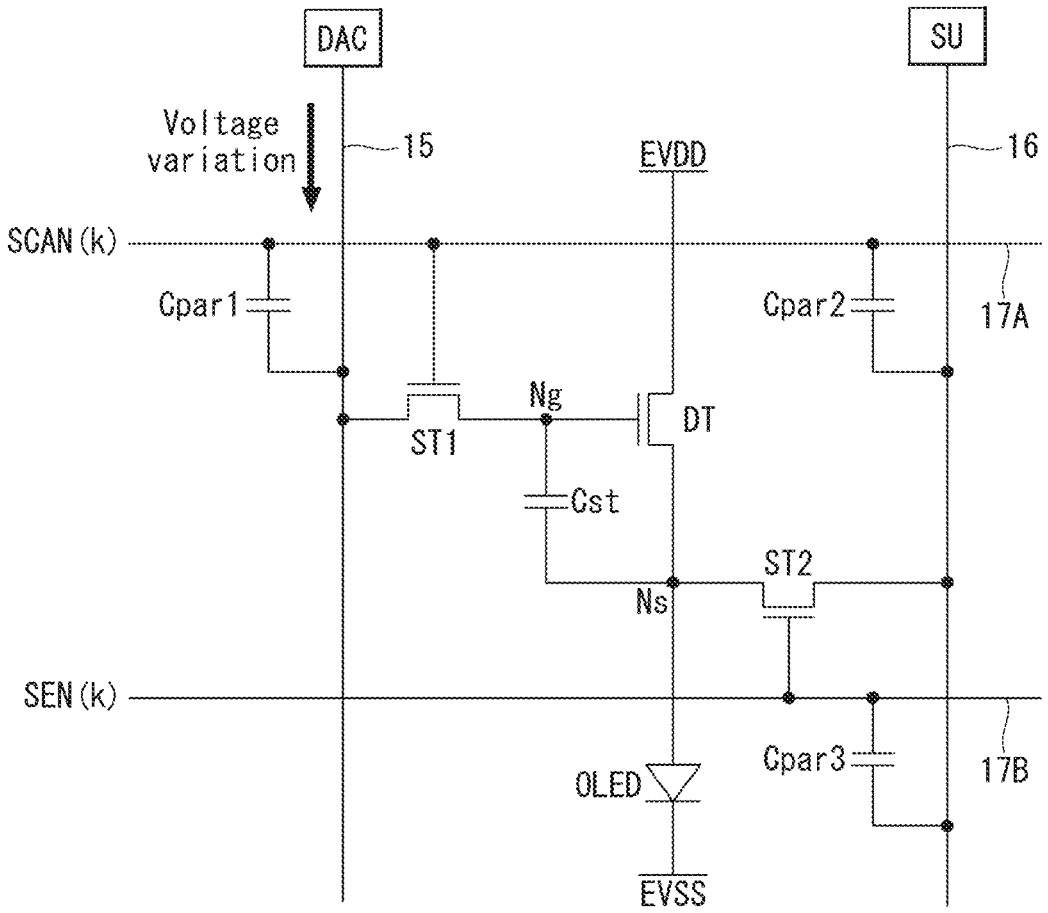
Figure 19:
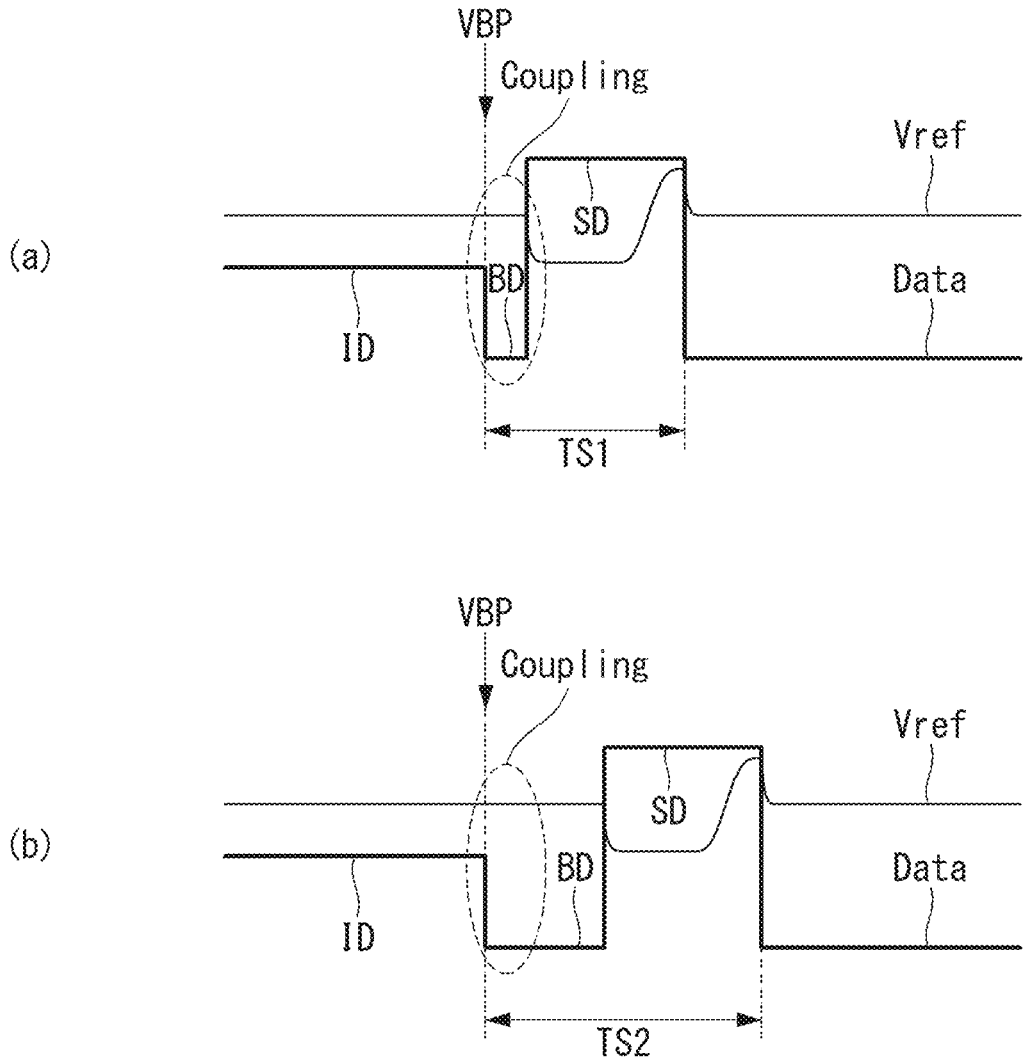

FIGS. 16 and 17 are diagrams for describing a coupling phenomenon that may occur between lines arranged in horizontal and vertical directions and FIGS. 18 and 19 are diagrams for describing a sensing deviation caused during a vertical blank period according to the coupling phenomenon described in FIGS. 16 and 17.

As shown in FIGS. 16 and 17, the first and second gate lines 17A and 17B are disposed in the horizontal direction and the data line 15 and the reference voltage line 16 are disposed in the vertical direction. Accordingly, parasitic capacitors Cpar1 to Cpar3 are generated between the horizontal lines 17A and 17B in the horizontal direction and the vertical lines 15 and 16 in the vertical direction. Particularly, the amount of parasitic charges charged in the parasitic capacitors Cpar1 to Cpar3 increases or decreases in response to changes in data voltages applied through the data line 15, that is, voltage variations. The first and second gate lines 17A and 17B are defined as one gate line and a coupling phenomenon that may occur around the gate line according to data voltage variations is described below.

A gate signal applied through the gate lines 17A and 17B is generated in the form of a voltage that can operate the first switch TFT ST1 or the second switch TFT ST2 included in the pixel. Accordingly, parasitic capacitances of the parasitic capacitors Cpar1 to Cpar3 change when a data voltage applied through the data line 15 changes. Since a gate signal is generated in the form of a logic high or logic low voltage in general, voltage change according to positive or negative coupling occurs in response to data voltage change.

As can be ascertained through voltage changes appearing at points P1, P2 and P3 after the coupling phenomenon occurs in the gate line 17A and 17B, this phenomenon is smoothly restored over time. However, parasitic capacitance variation according to the coupling phenomenon may affect the reference voltage line 16 in an electrical floating state, causing a sensing deviation.

As shown in FIG. 18, generation of a sensing deviation (S150) is highly likely to occur when black image data BD is applied to the last data line (S120) after a vertical blank period VBP starts (S110). When the black image data BD is applied to the last data line (S120), the influence of coupling spreads to adjacent associated lines such as coupling between a data line and a gate line (Data→Gate Line) (S130) and coupling between a gate line and a reference voltage line (Gate→Vref Line) (S140).

As can be ascertained through the above description, since two clock groups are provided in the embodiment of the present disclosure, sensing timing is divided into two sensing timings, and when the light emitting display device is operated on the basis of these timings, the pixel array can be divided into a plurality of areas A and a plurality of areas B and driven, as shown in FIG. 11. In addition, SDW for sensing and compensating for predetermined pixels can be performed during the vertical blank period VBP, as shown in FIG. 13. Further, input image data is applied before the vertical blank period VBP starts (S110), but the black image data BD is applied after the vertical blank period VBP starts (S110).

As shown in (a) and (b) of FIG. 19, a data voltage Data applied to a data line changes to black image data BD when the vertical blank period VBP starts while input image data ID is applied and then changes to sensing data SD. As can be seen from (a) and (b) of FIG. 19, when there is a difference between times at which the black image data BD is applied to pixels after the vertical blank period VBP starts, a difference between times "TS1" and "TS2" for sensing is also present. Furthermore, as can be ascertained from variations in the data voltage Data applied to the data line and a reference voltage Vref applied to the reference voltage line, operation is affected by coupling due to voltage variation during the vertical blank period VBP. In addition, pixels in a certain area are affected by sensing available time reduction due to a difference between times for sensing.

As described above, although coupling is smoothly restored over time, sensing start times are different even in the case of the same sensing time when there is a difference between times for sensing, leading to a sensing deviation. More specifically, since SDW is performed for at least one predetermined sub-pixel per frame, sensing pixel current is sampled at a point at which considerable coupling occurs with respect to an I-th pixel, whereas the sensing pixel current is sampled at a point at which insignificant coupling occurs with respect to an L-th pixel at a position different from the I-th pixel, causing a sensing deviation between the I-th pixel and the L-th pixel.

Figure 20:
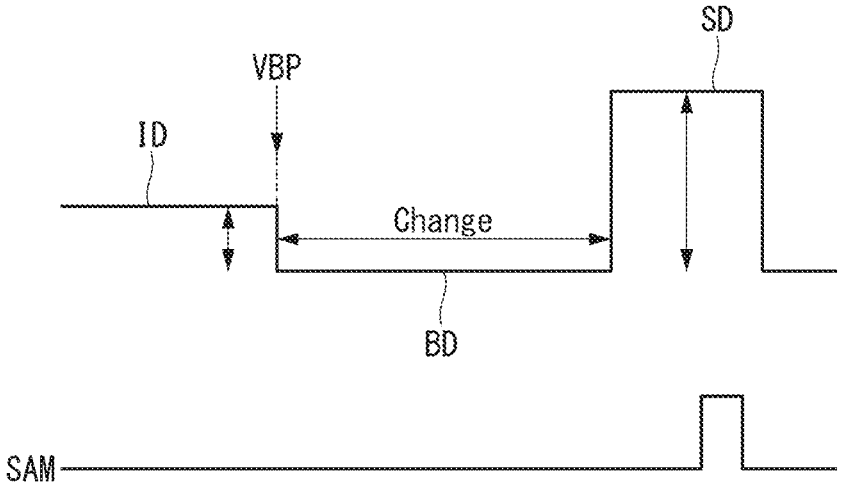
FIGS. 20 and 21 are diagrams showing a driving method according to a first example.
Figure 21:
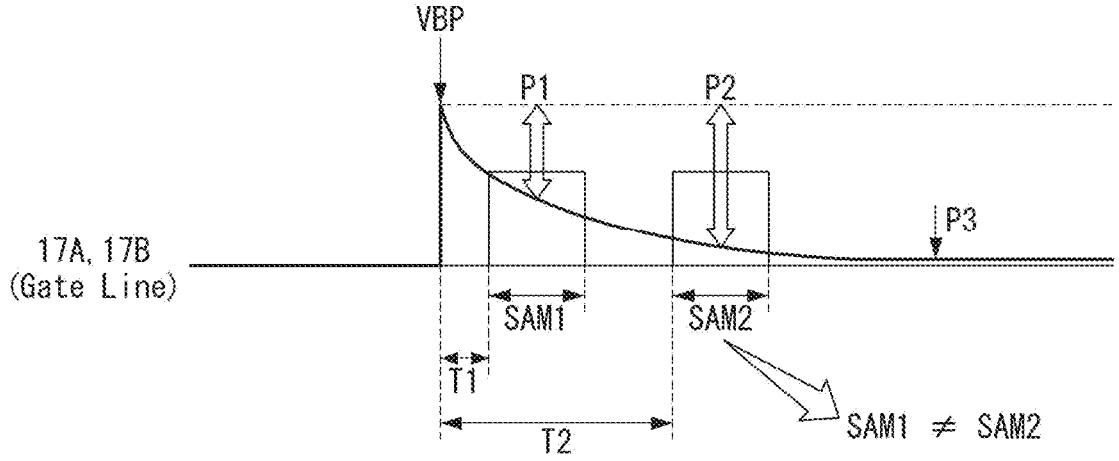
Figure 22:
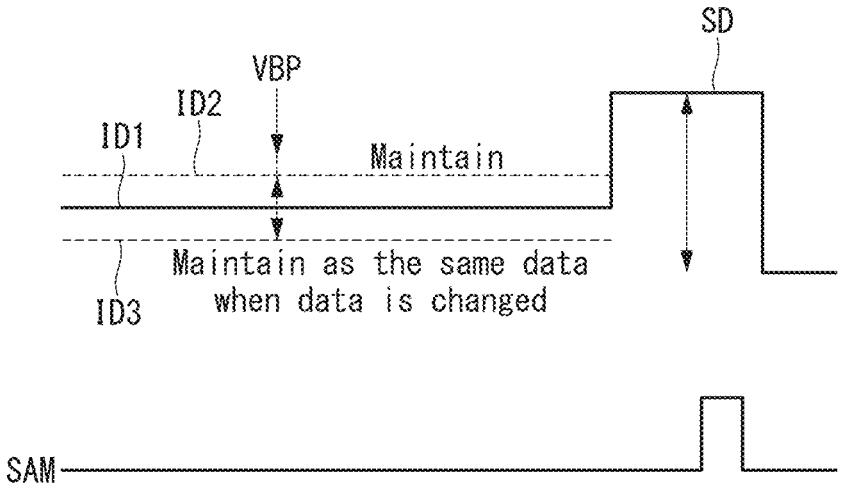
FIGS. 22 and 23 are diagrams showing a driving method according to a second example.
Figure 23:
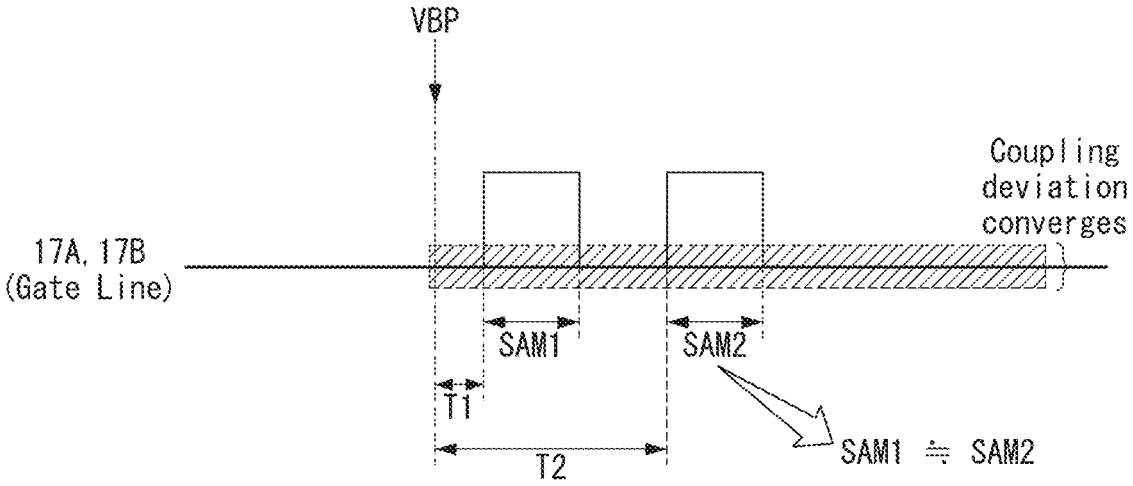

FIGS. 20 and 21 are diagrams showing a driving method according to a first example and FIGS. 22 and 23 are diagrams showing a driving method according to a second example.

As shown in FIG. 20, the driving method according to the first example applies input image data ID, and when the vertical blank period VBP starts, applies data different from the input image data ID, for example, black image data BD. Here, the black image data BD may be varied according to characteristics of the input image data ID applied in advance. After the black image data BD is applied, sensing data SD is applied for SDW and a sampling signal SAM for sensing the sensing data SD is applied. For example, when a logic high sampling signal SAM is applied, a voltage charged in a reference voltage line is sensed through a sensing unit.

As described above with reference to FIGS. 16 to 19, when the driving method according to the first example is used, a voltage difference according to coupling is generated in gate lines 17A and 17B after the vertical blank period VBP starts. Accordingly, when reference voltage lines are sampled for SDW for an I-th pixel present in an area A of FIG. 11 and an L-th pixel present in an area B, for example, during the vertical blank period VBP, operation is performed as shown in FIG. 21.

As shown in FIG. 21, the reference voltage line of the I-th pixel present in the area A is sampled according to a first sampling signal SAM1 applied after the lapse of a time "T1" from the start of the vertical blank period VBP. In addition, the reference voltage line of the L-th pixel present in the area B is sampled according to a second sampling signal SAM2 applied after the lapse of a time "T2" from the start of the vertical blank period VBP.

As described above, the I-th pixel present in the area A and the L-th pixel present in the area B have different sampling start times due to characteristics of the driving method although they have the same sampling time, and thus sampling is performed at different times, such as "T1" and "T2". However, sampling is performed at a point P1 at which considerable coupling occurs in the I-th pixel present in the area A, whereas sampling is performed at a point P2, the coupling of which is lower than that of the point P1, in the L-th pixel present in the area B.

As a result, a difference between a sampling value of the I-th pixel present in the area A and a sampling value of the L-th pixel present in the area B is generated (SAM1≠SAM2), and thus a deviation compensator capable of correcting or compensating for such a sensing deviation is desirable.

As shown in FIG. 22, the driving method according to the second example does not change data and maintains the data as input image data ID1 even if the vertical blank period VBP starts while the input image data ID1 is applied. Even when the input image data ID1 is changed to ID2 or ID3 immediately before the vertical blank period VBP, the input image data ID2 or ID3 which has been input (or changed) is maintained until sensing data SD is applied. In addition, application of the input image data ID1 to ID3 is blocked and, simultaneously, the sensing data SD is applied and a sampling signal SAM for sensing the sensing data SD is applied for SDW. As in the aforementioned example, a voltage charged in a reference voltage line is sensed through a sensing unit when a logic high sampling signal SAM is applied.

When the driving method according to the second example is used, a voltage difference due to coupling may be generated in the gate lines 17A and 17B after the vertical blank period VBP starts, but coupling much less than that in the driving method according to the first example occurs or the influence of coupling is barely present. This is because generation of coupling due to data voltage variation is restrained because previous data is continuously maintained even when the vertical blank period VBP starts. Accordingly, when reference voltage lines are sampled for SDW operation for an I-th pixel present in an area A of FIG. 11 and an L-th pixel present in an area B, for example, during the vertical blank period VBP, operation is performed as shown in FIG. 23. However, the present disclosure is not limited thereto. The coupling compensation data may be any data that decreasing the data voltage variation, which is written during the vertical blank period. In one embodiment, the difference of the coupling compensation data and a previous input image data applied immediately before the vertical blank period starts may be within a predetermined range, to control the sensing deviation in an expected range. In one embodiment, the coupling compensation data is the same as a previous input image data applied immediately before the vertical blank period starts, to minimize the sensing deviation.

As shown in FIG. 23, the reference voltage line of the I-th pixel present in the area A is sampled according to a first sampling signal SAM1 applied after the lapse of a time "T1" from the start of the vertical blank period VBP. In addition, the reference voltage line of the L-th pixel present in the area B is sampled according to a second sampling signal SAM2 applied after the lapse of a time "T2" from the start of the vertical blank period VBP.

As described above, the I-th pixel present in the area A and the L-th pixel present in the area B have different sampling start times due to characteristics of the driving method although they have the same sampling time, and thus sampling is performed at different times, such as "T1" and "T2". However, sampling is performed at a point at which little coupling deviation is present, that is, the coupling deviation converges in the I-th pixel present in the area A and the L-th pixel present in the area B.

As a result, a sampling value of the I-th pixel present in the area A is similar to a sampling value of the L-th pixel present in the area B (SAM1≈SAM2), and thus a deviation compensator capable of correcting or compensating for a sensing deviation can be omitted (eliminated). That is, the driving method according to the second example is a method of inserting coupling compensation data (or coupling stabilization data) between input image data and sensing data in order to minimize generation of coupling.

According to the above description, various embodiments of the present disclosure can realize a device on the basis of the driving method according to the first example or the second example in consideration of a timing difference between first half and last half and a sensing deviation caused thereby by dividing clocks applied to the gate driver (into the clock group A and the clock group B in FIG. 10A) and separately operating the divided clocks in order to divide a pixel array into upper and lower areas A and B and driving the pixel array. In addition, various embodiments of the present disclosure can realize a device such that the device is driven by the driving method according to the first or second example in consideration of data applied before a vertical blank period VBP starts and the influence of coupling according thereto. Meanwhile, sampling times in FIGS. 21 and 23 should be understood as an example described with a difference between sampling times for extreme comparison between two pixels.

According to various embodiments of the present disclosure, a device can be realized in consideration of a sensing deviation that may be generated in a compensation operation for improving deterioration of elements included in a display panel and increasing the lifespan thereof, and a driving method can be selected. In addition, various embodiments of the present disclosure can minimize the likelihood of generation of a sensing deviation in the compensation operation for improving deterioration of elements included in a display panel to achieve uniform and accurate compensation and maintain uniform display quality. Furthermore, various embodiments of the present disclosure can commonly use clock lines without separating the clock lines in order to divide a pixel array into upper and lower areas and separately drive the pixel array in the compensation operation for improving deterioration of elements included in a display panel, preventing a bezel area from increasing.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A light emitting display device, comprising:

a display panel including pixel lines having a plurality of pixels, the pixel lines being in a first area and a second area;

a panel driver electrically connected to the pixel lines; and a timing controller configured to control operation of the panel driver to perform image data writing driving for sequentially applying input image data to a plurality of pixel lines included in one of the first area or the second area, and to perform sensing data writing driving for applying sensing data to a pixel line included in the one of the first area or the second area during a vertical blank period in which the image data writing driving is not performed, wherein the timing controller writes coupling compensation data during the vertical blank period, wherein the timing controller is configured to perform black data insertion driving for concurrently inserting black image data into a plurality of pixel lines included in the other one of the first area or the second area.

2. The light emitting display device of claim 1, wherein the coupling compensation data is written subsequent to the input image data and prior to the sensing data.

3. The light emitting display device of claim 1, wherein a difference between the coupling compensation data and a previous input image data applied before the vertical blank period starts is within a predetermined range.

4. The light emitting display device of claim 3, wherein the coupling compensation data is the same as the previous input image data applied before the vertical blank period starts.

5. The light emitting display device of claim 1, wherein an applied state of the coupling compensation data is maintained until the sensing data is applied.

6. The light emitting display device of claim 1, wherein the pixel lines in the first area and the pixel lines in the second area are sampled at the same time and have different sampling start times.

7. The light emitting display device of claim 1, wherein the pixel lines in the first area are driven by a gate driver provided with a first clock group and the pixel lines in the second area are driven by a gate driver provided with a second clock group having a phase different from that of the first clock group.

8. The light emitting display device of claim 7, wherein the timing controller is configured to alternately output black data insertion scan clock signals of the first clock group and black data insertion scan clock signals of the second clock group at least once within one clock cycle.

9. The light emitting display device of claim 1, wherein:

the timing controller is configured to divide pixel line selection and cancellation signals into a first pixel line selection and cancellation signal and a second pixel line selection and cancellation signal, the black data insertion driving is performed for the second area and the sensing data writing driving is performed only for the first area when the first pixel line selection and cancellation signal is activated only, and the black data insertion driving is performed for the first area and the sensing data writing driving is performed only for the second area when the second pixel line selection and cancellation signal is activated only.

10. A light emitting display device, comprising:

a display panel including pixel lines having a plurality of pixels, the pixels lines being in a first area and a second area;

a panel driver electrically connected to the pixel lines; and a timing controller configured to control operation of the panel driver to perform image data writing driving for sequentially writing input image data to a plurality of pixel lines included in one of the first area or the second area, and to perform sensing data writing driving for writing sensing data to a pixel line included in the one of the first area or the second area during a vertical blank period in which the image data writing driving is not performed, wherein the timing controller includes a deviation compensator configured to compensate a sensing deviation caused by coupling between horizontal lines and vertical lines in the display panel.

11. The light emitting display device of claim 10, wherein the pixel lines included in the first area and the pixel lines included in the second area are sampled at the same time and have different sampling start times.

12. The light emitting display device of claim 10, wherein the timing controller is configured to perform black data insertion driving for concurrently inserting black image data into a plurality of pixel lines included in the other one of the first area or the second area.

13. The light emitting display device of claim 12, wherein the pixel lines in the first area are driven by a gate driver provided with a first clock group and the pixel lines included in the second area are driven by a gate driver provided with a second clock group having a phase different from that of the first clock group.

14. The light emitting display device of claim 13, wherein the timing controller is configured to alternately output black data insertion scan clock signals of the first clock group and black data insertion scan clock signals of the second clock group at least once within one clock cycle.

15. The light emitting display device of claim 12, wherein:

the timing controller is configured to divide pixel line selection and cancellation signals into a first pixel line selection and cancellation signal and a second pixel line selection and cancellation signal, the black data insertion driving is performed for the second area and the sensing data writing driving is performed only for the first area when the first pixel line selection and cancellation signal is activated only; and the black data insertion driving is performed for the first area and the sensing data writing driving is performed only for the second area when the second pixel line selection and cancellation signal is activated only.

16. A method of driving a light emitting display device having a display panel including pixel lines having a plurality of pixels, the pixel lines being in a first area and a second area, the method comprising:

performing image data writing driving for sequentially writing input image data to a plurality of pixel lines included in one of the first area or the second area;

performing sensing data writing driving for writing sensing data to a pixel line included in the one of the first area or the second area during a vertical blank period in which image data writing driving is not performed; and compensating for a sensing deviation caused by coupling between horizontal lines and vertical lines in the display panel.

* * * * *